US012044239B2

(12) United States Patent
Shimizu et al.

(10) Patent No.: US 12,044,239 B2
(45) Date of Patent: Jul. 23, 2024

(54) SUBMERSIBLE PUMP SYSTEM, INFORMATION PROCESSING DEVICE, AND COMPUTER PROGRAM

(71) Applicant: ShinMaywa Industries, Ltd., Hyogo (JP)

(72) Inventors: Hiromasa Shimizu, Hyogo (JP); Akihiro Ando, Hyogo (JP); Shiro Fukami, Hyogo (JP); Shogo Ueda, Hyogo (JP); Hideyuki Kato, Hyogo (JP)

(73) Assignee: ShinMaywa Industries, Ltd., Hyogo (JP)

( * ) Notice: Subject to any disclaimer, the term of this patent is extended or adjusted under 35 U.S.C. 154(b) by 228 days.

(21) Appl. No.: 17/630,363

(22) PCT Filed: Aug. 7, 2020

(86) PCT No.: PCT/JP2020/030459
§ 371 (c)(1),
(2) Date: Jan. 26, 2022

(87) PCT Pub. No.: WO2021/029387
PCT Pub. Date: Feb. 18, 2021

(65) Prior Publication Data

US 2022/0268284 A1 Aug. 25, 2022

(30) Foreign Application Priority Data

Aug. 9, 2019 (JP) ..... 2019-147684

(51) Int. Cl.
*F04D 15/02* (2006.01)
*F04B 49/06* (2006.01)
*F04D 13/08* (2006.01)

(52) U.S. Cl.
CPC ..... *F04D 15/0218* (2013.01); *F04B 49/065* (2013.01); *F04D 13/086* (2013.01); *F04D 15/0236* (2013.01)

(58) Field of Classification Search
CPC ..... F04D 15/0236; F04D 15/0218; F04D 15/0245; G01R 19/0092
(Continued)

(56) References Cited

U.S. PATENT DOCUMENTS 10,737,753 B1 * 8/2020 Gonring ..... B63J 99/00
2018/0112658 A1 * 4/2018 Fosmark ..... F04D 15/0218

FOREIGN PATENT DOCUMENTS

JP H2-259290 A 10/1990
JP 2003-035275 A 2/2003
(Continued)

OTHER PUBLICATIONS

NIST Pub., Section 8 Statistical Techniques (NIST.IR.6969-2019-'section-8-statistics-techniques-20190506.pdf'), (2019) (Year: 2019).*
(Continued)

*Primary Examiner* — Kenneth J Hansen
(74) *Attorney, Agent, or Firm* — Renner, Otto, Boisselle & Sklar, LLP

(57) ABSTRACT

A storage unit is configured to store a drive electric current of a submersible pump detected by an electric current detection unit. An identification unit is configured to calculate at least one electric current parameter of a plurality of electric current parameter based on the temporal change of the drive electric current and identify an operation state indicating whether there is an abnormality in the submersible pump and a type of an abnormal operation, based on the electric current parameter.

14 Claims, 21 Drawing Sheets

(58) Field of Classification Search
USPC ..... 417/17, 18; 702/64, 79
See application file for complete search history.

(56) References Cited

FOREIGN PATENT DOCUMENTS

| | | | |
|---|---|---|---|
| JP | 2008-208807 | A | 9/2008 |
| JP | 6234732 | B2 | 11/2017 |
| JP | 2018-055150 | A | 4/2018 |
| JP | 2020-107072 | A | 7/2020 |

OTHER PUBLICATIONS

International Search Report for corresponding Application No. PCT/JP2020/030459, mailed Sep. 8, 2020.

* cited by examiner

SUBMERSIBLE PUMP SYSTEM, INFORMATION PROCESSING DEVICE, AND COMPUTER PROGRAM

TECHNICAL FIELD

The present disclosure relates to a submersible pump system, an information processing device, and a computer program.

BACKGROUND ART

Conventionally, as a submersible pump system used for controlling a submersible pump installed in a storage tank of a manhole in which sewage is stored or the like, for example, submersible pump systems disclosed in PATENT DOCUMENT 1 and PATENT DOCUMENT 2 have been proposed.

Specifically, in PATENT DOCUMENT 1, a submersible pump system (abnormality detection device) including a storage tank (water tank unit) that stores sewage that has flowed in from an inflow pipe, a plurality of submersible pumps that drain the sewage stored in the storage tank to an outflow pipe, a water gauge that measures a water level of the sewage stored in the storage tank, and a control unit that, when the water level measured by the water gauge reaches a pump start water level, starts one of the submersible pumps to drain the sewage to the outflow pipe and, when the water level reaches a pump stop water level, executes sewage carrying control to stop the submersible pump is disclosed.

The submersible pump system includes a storage unit that stores a pump operation time or a pump drive electric current as a characteristic value while each of the pumps is operated and an abnormality determination unit that calculates an average characteristic value per predetermined number of times the pump has been started from the characteristic values stored in the storage unit and identifies, based on a comparison result for the respective average characteristic values of the submersible pumps, whether an abnormality of a system specific to each of the submersible pumps has occurred or an abnormality of a system common to the submersible pumps that has occurred.

In PATENT DOCUMENT 2, a method in which water level change speed is detected using a water gauge that detects a water level of a pump well, a difference between the water level change speed and a setting value or whether there is a change point of temporal change of the water level change speed is detected, and thus, a failure of a pump is determined is disclosed.

CITATION LIST

Patent Document

PATENT DOCUMENT 1: Japanese Patent No. 6234732
PATENT DOCUMENT 2: Japanese Unexamined Patent Publication No. H02-259290

SUMMARY OF THE INVENTION

Technical Problem

In the submersible pump system of PATENT DOCUMENT 1, in the submersible pump, when a predetermined operation time is delayed or when an electric current deviates from a predetermined electric current, an abnormal state of the submersible pump (that is, whether there is an abnormality of the submersible pump) can be known.

However, in the submersible pump system of PATENT DOCUMENT 1, an abnormality determination unit merely determines the abnormal state of the submersible pump, based on the above-described result of comparison of the average characteristic values, and therefore, a cause of occurrence of the abnormality in the submersible pump cannot be specifically specified. As a result, it is not possible to precisely understand contents of a failure that has occurred in the submersible pump system, and it is difficult to take measures to restore the submersible pump system from its failure state. Furthermore, because the cause for occurrence of the abnormality in the submersible pump cannot be specifically specified, preventive maintenance of the submersible pump system cannot be properly preformed.

In the pump failure determination method of PATENT DOCUMENT 2, when water level change speed is detected and the detected water level change speed is compared to a set value and then is found to have deviated from the set value, or if, in a case where whether there is a change point is detected, the change point cannot be detected even after a set time is reached, it is possible to find an abnormality of a submersible pump, but a cause for occurrence of the abnormality in the submersible pump cannot be specifically specified. As a result, it is difficult to take measures to restore the submersible pump system from its failure state, and furthermore, preventive maintenance of the submersible pump system cannot be properly performed.

As described above, in each of the submersible pump systems of PATENT DOCUMENT 1 and PATENT DOCUMENT 2, an abnormal state of a submersible pump cannot be specifically specified and contents of a failure of the submersible pump system cannot be clearly understood.

In view of the foregoing, the present disclosure has been devised and it is therefore an object of the present disclosure to specifically specify whether there is an abnormality in a submersible pump and a type of an abnormal operation to clearly understand contents of a failure of a submersible pump system.

Solution to the Problem

In a submersible pump used for a submersible pump system, a different operation state (abnormal state) from a normal operation is seen in some cases. The present inventor conducted an analysis based on an electric current parameter calculated from temporal change of a drive electric current of the submersible pump to find that whether there is an abnormality of the submersible pump and a type of a representative abnormal operation can be specified.

Specifically, in order to achieve the above-described object, according to a first aspect of the present disclosure, a submersible pump system includes a submersible pump that pumps stored water, an electric current detection unit that detects a drive electric current value of the submersible pump, a storage unit that stores the drive electric current value detected by the electric current detection unit, and an identification unit that can transmit and receive data to and from the storage unit.

The storage unit is configured to store temporal change of the detected drive electric current of the submersible pump. Herein, the electric current detection unit may be included in a control unit and may be provided independently from the control unit on a route of the drive electric current of the submersible pump. The drive electric current of the submersible pump that is detected by the electric current detection unit and is stored in the storage unit may include a value obtained in some other time than a driving time.

Each of a drive electric current value stored in the storage unit and a drive electric current value used for identification may be a drive electric current value excluding a drive electric current value in some other time than the driving time, depending on the drive electric current value.

The identification unit is configured to calculate at least one electric current parameter of a plurality of electric current parameters based on the temporal change of the drive electric current and identify an operation state indicating whether there is an abnormality in the submersible pump and a type of an abnormal operation, based on the electric current parameter. Herein, calculation of the electric current parameter may be performed in any location if the temporal change of the drive electric current can be obtained, and a calculation unit that calculate the electric current parameter may be separately provided. The storage unit may be configured to store a drive electric current value and a detection time of the drive electric current value, and the calculated electric current parameter and temporal change thereof.

According to the first aspect, by conducting a detailed analysis, based on at least one electric current parameter calculated from the temporal change of the drive electric current in the submersible pump, it is possible to specifically specify whether there is an abnormality in the submersible pump and a type of an abnormal operation (for example, an airlock, an idle operation, foreign object blockage, foreign object passing, foreign object staying, an over-capacity inflow, and an excessive inflow) as an operation state (which will be hereinafter simply referred to as an "operation state"). Accordingly, according to the first aspect, it is possible to specifically specify whether there is an abnormality in the submersible pump and a type of an abnormal operation and thus make failure contents of the submersible pump system clear. Then, by making the failure contents in the submersible pump system clear, it is possible to take measures to restore the submersible pump system from a failure state in advance, for example, before directly going to a pump station in which the submersible pump is installed. It is also possible to change as appropriate an order of priorities in order to restore the submersible pump system from a failure state. Furthermore, it is possible to perform preventive maintenance of the submersible pump system.

According to a second aspect, in the submersible pump system of the first aspect, the plurality of electric current parameters include a standard deviation of the drive electric current, an maximum value and a minimum value of the drive electric current, a ratio between the maximum value and the minimum value of the drive electric current, a change amount of the drive electric current per unit time, and a total number of electric current change points, that is, points at which a degree of the temporal change of the drive electric current changed, in a predetermined period.

According to the second aspect, by conducting a detailed analysis using different types of electric current parameters, the operation state of the submersible pump can be highly accurately specified.

According to a third aspect, the submersible pump system of the first or second aspect further includes a water level detector that detects a water level of the stored water. The storage unit is configured to store temporal change of the water level detected by the water level detector. The identification unit is configured to calculate at least one water level parameter of a plurality of water level parameters based on the temporal change of the water level and identify the operation state of the submersible pump, based on the water level parameter and the electric current parameter.

According to the third aspect, it is possible to analyze the temporal change of the drive electric current and the temporal change of the water level in detail while mutually comparing the water level parameter and the electric current parameter with one another. As a result, accuracy with which the operation state of the submersible pump is specified can be increased.

According to a fourth aspect, in the submersible pump system of any one of the first to third aspects, the identification unit is configured to calculate two or more electric current parameters of the plurality of electric current parameters and identify the operation state of the submersible pump, based on the electric current parameters.

According to the fourth aspect, it is possible to analyze the temporal change of the drive electric current in detail while mutually comparing the different electric current parameters. As a result, the accuracy with which the operation state of the submersible pump is specified can be further increased.

According to a fifth aspect, in the submersible pump system of any one of the first to fourth aspects, at least one of the identification unit and the storage unit is configured to execute learning control in which a virtual boundary that divides the operation state of the submersible pump is set using the electric current parameter.

According to the fifth aspect, accuracy with which the operation state of the submersible pump is identified can be increased and, as a result, the failure contents of the submersible pump system can be made further clearer.

According to a sixth aspect, a submersible pump system includes a submersible pump that pumps stored water, a water level detector that detects a water level of the stored water, a storage unit that can store temporal change of the water level detected by the water level detector, and an identification unit that can transmit and receive data to and from the storage unit. The identification unit is configured to calculate at least one water level parameter of a plurality of water level parameters based on the temporal change of the water level and identify an operation state indicating whether there is an abnormality in the submersible pump and a type of an abnormal operation, based on the water level parameter.

According to the sixth aspect, the operation state of the submersible pump can be specifically specified by analyzing the temporal change of the water level in detail, based on at least one water level parameter. Accordingly, the failure contents of the submersible pump system can be made clear.

According to a seventh aspect, in the submersible pump system of the sixth aspect, at least one of the storage unit and the identification unit is configured to execute learning control in which a virtual boundary that divides the operation state of the submersible pump is set using the water level parameter.

According to the seventh aspect, the accuracy with which the operation state of the submersible pump is identified can be increased and, as a result, the failure contents of the submersible pump system can be made further clearer.

According to an eighth aspect, in the submersible pump system of any one of the first to seventh aspects, the submersible pump includes a detection unit for pump. The detection unit for pump is configured to detect at least one of a water content of oil contained in a pump main body forming the submersible pump, a flooded state in an electric motor forming the submersible pump, temperature of a bearing member forming the submersible pump, a discharge amount and a discharge pressure of the submersible pump, and an oscillation value, an insulation resistance value, and winding temperature of the electric motor.

According to the eighth aspect, based on a detection result of the detection unit for pump, it is possible to individually specify failure contents caused by a specific configuration of the submersible pump and also predict a future failure. Specifically, the detection unit for pump detects a state of shifting from a normal value to an abnormal value for at least one of the above-described elements, so that the failure contents of the submersible pump caused by the specific configuration and a portion thereof that has been deteriorated through years can be individually specified and a failure of the submersible pump can be prevented in advance.

According to a ninth aspect, in the submersible pump system of the eighth aspect, the identification unit is configured to predict a future operation state of the submersible pump from both of the operation state of the submersible pump and a detection result of the detection unit for pump.

According to the ninth aspect, the identification unit predicts a future operation state of the submersible pump from both of the operation state of the submersible pump and a detection result of the detection unit for pump, so that a future operation state of the submersible pump can be predicted with high accuracy.

According to a tenth aspect, in the submersible pump system of any one of the first to ninth aspects, the identification unit is configured to inform an external device of a type of an abnormal operation of the submersible pump, based on the operation state of the submersible pump.

According to the tenth aspect, the identification unit informs the external device of a type of an abnormal operation of the submersible pump, based on the operation state of the submersible pump, so that the failure contents of the submersible pump system can be understood in an early stage. As a result, measures to restore the submersible pump system from a failure state can be taken in an early stage.

According to an eleventh aspect, the submersible pump system of the tenth aspect further includes a control unit that controls operation and stop of the submersible pump. A plurality of the submersible pumps are provided. The control unit performs control such that one of the submersible pumps that has been determined to be highly likely in an abnormal state, based on the operation state of each of the plurality of submersible pumps, by the identification unit is stopped to be driven only at emergency.

According to the eleventh aspect, one of the submersible pumps that has been identified to be highly likely in an abnormal state by the identification unit can be auxiliary used as a backup submersible pump.

According to a twelfth aspect, a computer program for causing a computer to execute a process is provided, and the process includes causing the computer to function as the submersible pump system of any one of claims 1 to 11.

According to the twelfth aspect, the computer program that has similar effects to those of the first to eleventh aspects can be achieved.

According to a thirteenth aspect, an information processing device that specifies an operation state indicating whether there is an abnormality in a submersible pump and a type of an abnormal operation is provided, and the information processing device includes a storage unit that stores a drive electric current value of the submersible pump, and an identification unit that can transmit and receive data to and from the storage unit. The storage unit is configured to store detected temporal change of the drive electric current of the submersible pump. The identification unit is configured to calculate at least one electric current parameter of a plurality of electric current parameters based on the temporal change of the drive electric current and identify the operation state of the submersible pump, based on the electric current parameter.

According to the thirteenth aspect, the operation state of the submersible pump system can be specifically specified and the failure contents of the submersible pump system can be made clear.

According to a fourteenth aspect, in the information processing device of the thirteenth aspect, the storage unit is configured to store temporal change of a water level, and the identification unit is configured to calculate at least one water level parameter of a plurality of water level parameters based on the temporal change of the water level and identify the operation state of the submersible pump, based on the water level parameter and the electric current parameter.

According to the fourteenth aspect, it is possible to analyze the temporal change of the drive electric current and the temporal change of the water level in detail while mutually comparing the water level parameter and the electric current parameter with one another. As a result, the accuracy with which the operation state of the submersible pump is specified can be increased.

According to a fifteenth aspect, an information processing device that specifies an operation state indicating whether there is an abnormality in a submersible pump and a type of an abnormal operation is provided, and the information processing device includes a storage unit that can store temporal change of a water level of stored water, and an identification unit that can transmit and receive data to and from the storage unit. The identification unit is configured to calculate at least one water level parameter of a plurality of water level parameters based on the temporal change of the water level and identify the operation state of the submersible pump, based on the water level parameter.

According to the fifteenth embodiment, the operation state of the submersible pump can be specifically specified by analyzing the temporal change of the water level in detail, based on at least one water level parameter. Accordingly, the failure contents of the submersible pump system can be made clear.

According to a sixteenth aspect, a computer program that is used for specifying an operation state indicating whether there is an abnormality in a submersible pump and a type of an abnormal operation is provided, the computer program causes a computer to execute a process, and the process includes causing the computer to function as a storage unit that stores a drive electric current value of the submersible pump, and an identification unit that can transmit and receive data to and from the storage unit. The storage unit is configured to store temporal change of the detected drive electric current of the submersible pump. The identification unit is configured to calculate at least one electric current parameter of a plurality of electric current parameters based on the temporal change of the drive electric current and identify the operation state of the submersible pump, based on the electric current parameter.

According to the sixteenth aspect, using the computer program, the operation state of the submersible pump system can be specifically specified and the failure contents of the submersible pump system can be made clear.

According to a seventeenth aspect, in the computer program of the sixteenth aspect, the storage unit is configured to store temporal change of the water level, and the identification unit is configured to calculate at least one water level parameter of a plurality of water level parameters based on the temporal change of the water level and identify the operation state of the submersible pump, based on the water level parameter and the electric current parameter.

According to the seventeenth aspect, using the computer program, it is possible to analyze the temporal change of the drive electric current and the temporal change of the water level in detail while mutually comparing the water level parameter and the electric current parameter with one another. As a result, the accuracy with which the operation state of the submersible pump is specified can be increased.

According to an eighteenth aspect, a computer program that is used for specifying an operation state indicating whether there is an abnormality in a submersible pump and a type of an abnormal operation is provided, the computer program causes a computer to execute a program, and the process includes causing the computer to function as a storage unit that can store temporal change of a water level of stored water, and an identification unit that can transmit and receive data to and from the storage unit. The identification unit is configured to calculate at least one water level parameter of a plurality of water level parameters based on the temporal change of the water level and identify the operation state of the submersible pump, based on the water level parameter.

According to the eighteenth aspect, using the computer program, the operation state of the submersible pump can be specifically specified by analyzing the temporal change of the water level in detail, based on at least one water level parameter. Accordingly, the failure contents of the submersible pump system can be made clear.

Advantages of the Invention

As described above, according to the present disclosure, an operation state of a submersible pump system can be specifically specified and failure contents of the submersible pump system can be made clear.

DESCRIPTION OF EMBODIMENTS

Embodiments of the present disclosure will now be described in detail with reference to the drawings. The following description of the embodiments are mere examples by nature, and are not intended to limit the scope, application, or uses of the present disclosure.

Figure 1:
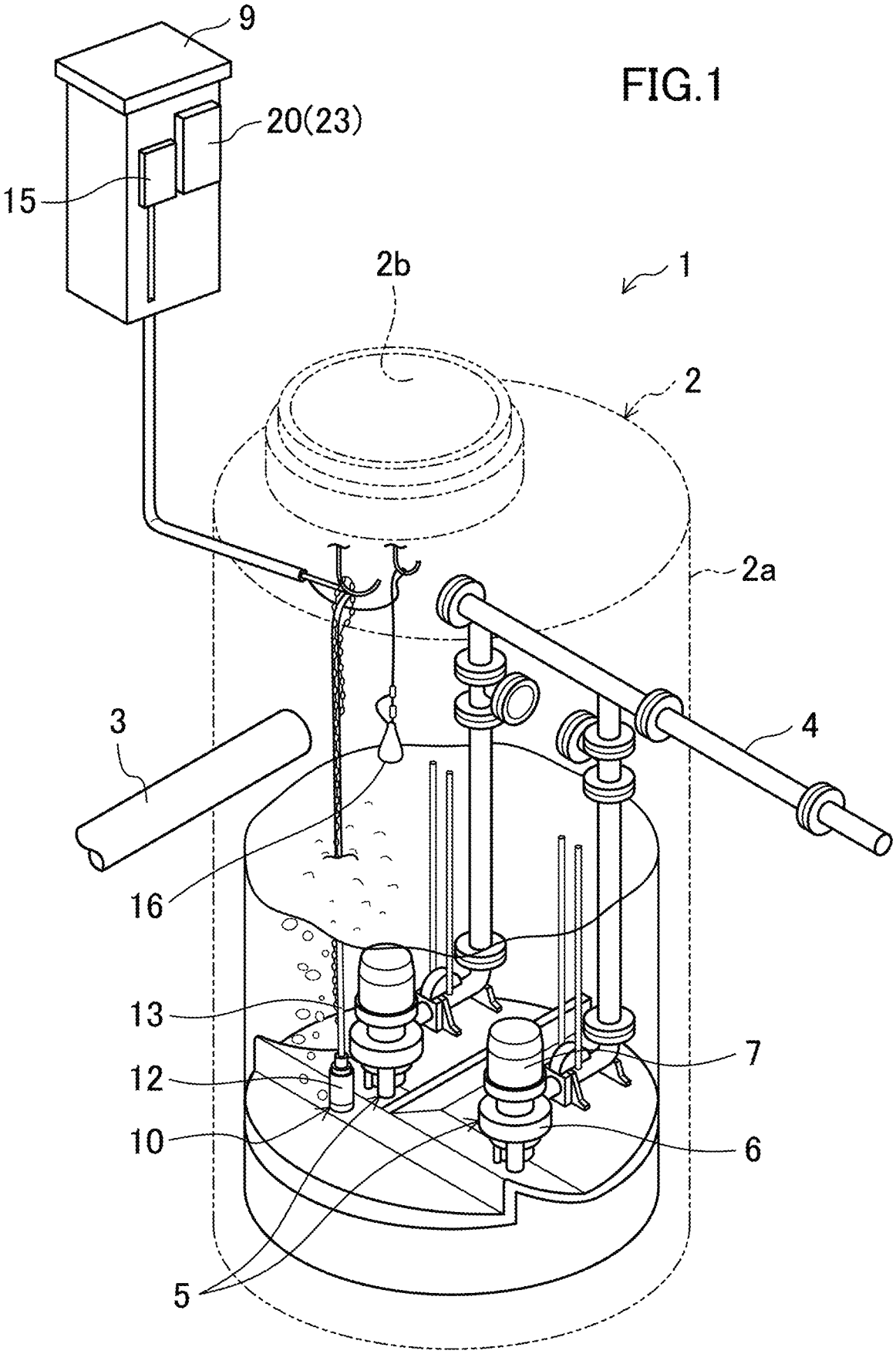
FIG. 1 is an overall perspective view schematically illustrating an overall configuration of a submersible pump system according to an embodiment of the present disclosure.
Figure 2:
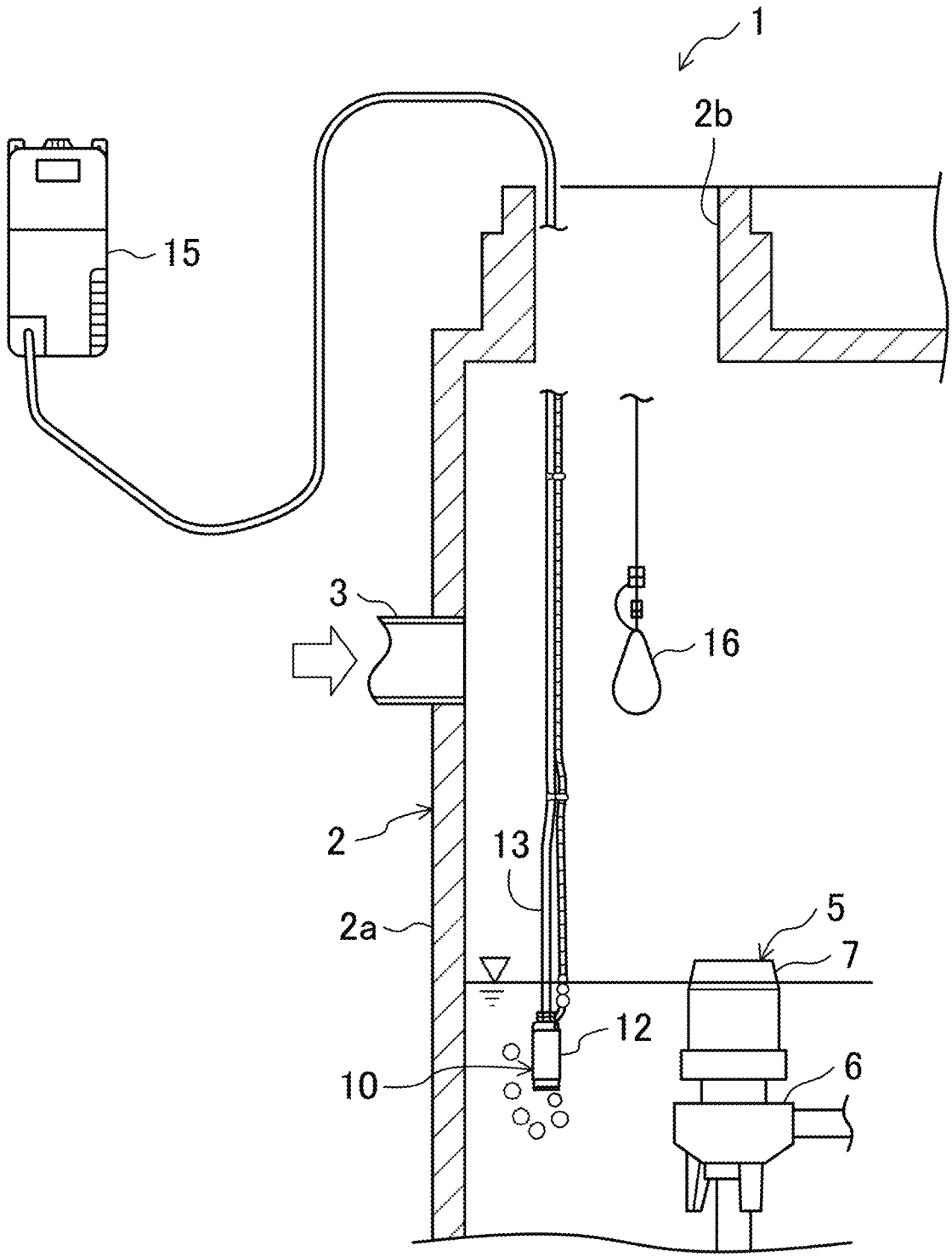
FIG. 2 is a cross-sectional view schematically illustrating a state where an inflow pipe, a submersible pump, and a water level detector are installed in a storage tank.
Figure 3:
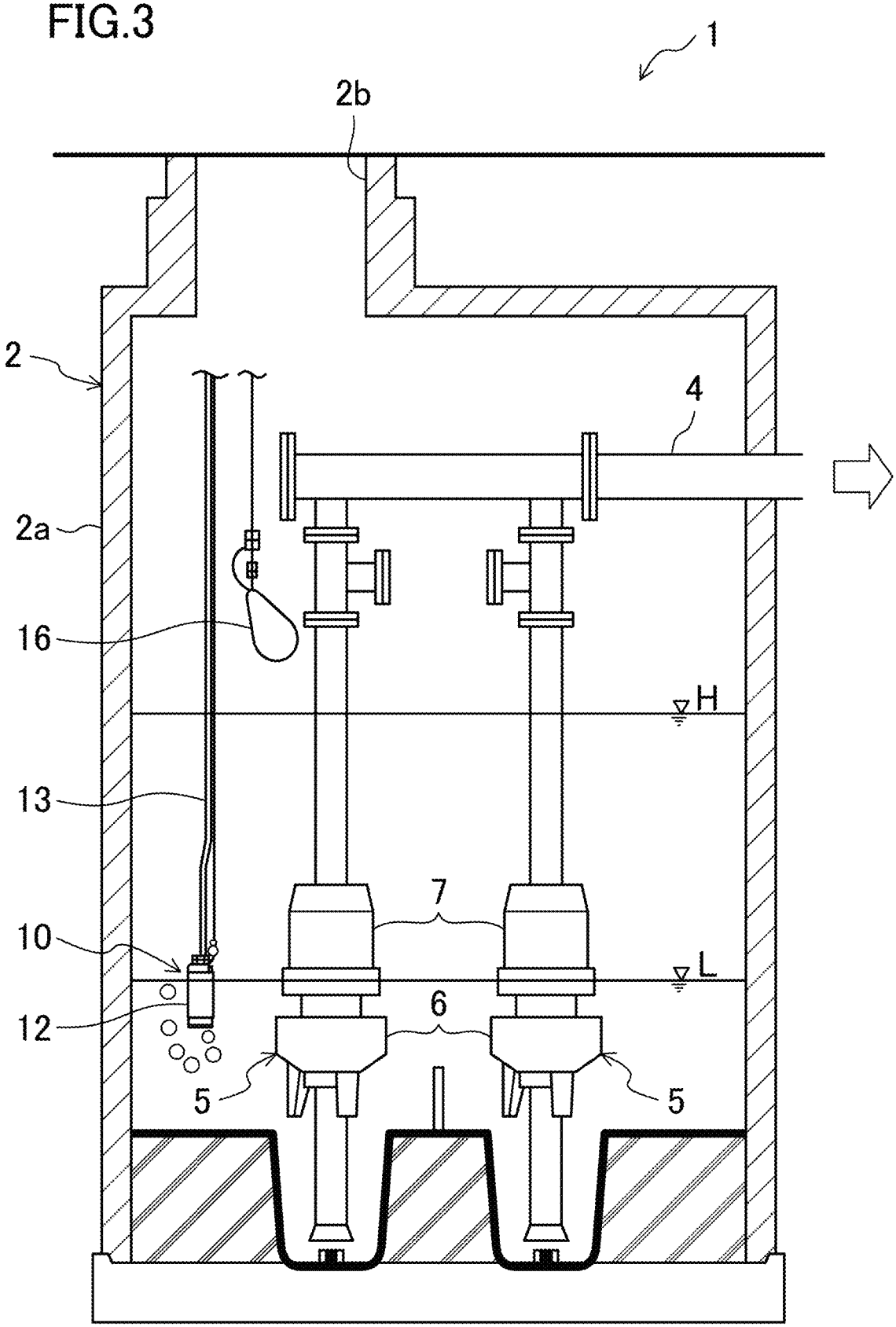
FIG. 3 is a cross-sectional view schematically illustrating a state where a discharge pipe, the submersible pump, and the water level detector are installed in the storage tank, when viewed from a different direction from that of FIG. 2.

FIG. 1 to FIG. 3 illustrate a submersible pump system 1 according to an embodiment of the present disclosure. The submersible pump system 1 is applied, for example, as a control system of a manhole pump system, a sewage drainage pumping station, a submersible pump for draining rain water, a submersible pump for river, a submersible pump for factory, or the like.

(Storage Tank)

As illustrated in FIG. 1 to FIG. 3, the submersible pump system 1 includes a storage tank 2. The storage tank 2 is configured as a manhole used for storing sewage that has flowed in from an inflow pipe 3 that will be described later. The storage tank 2 includes a tank main body 2*a* and an opening 2*b*. The storage tank 2 is configured such that the opening 2*b* is exposed to a ground surface with the tank main body 2*a* buried in the ground. The opening 2*b* is closed by an unillustrated lid.

(Inflow Pipe)

As illustrated in FIG. 1 and FIG. 2, the submersible pump system 1 includes the inflow pipe 3. The inflow pipe 3 causes sewage to flow in the storage tank 2. One end of the inflow pipe 3 is coupled to the tank main body 2*a*.

(Discharge Pipe)

As illustrated in FIG. 1 and FIG. 3, the submersible pump system 1 includes a discharge pipe 4. The discharge pipe 4 is used to discharge the sewage stored in the storage tank 2. The discharge pipe 4 is coupled to each submersible pump 5 that will be described later.

(Submersible Pump)

As illustrated in FIG. 1 to FIG. 3, the submersible pump system 1 includes two submersible pumps 5. Each of the submersible pumps 5 is coupled to the discharge pipe 4.

Each of the submersible pumps 5 is configured to pump the sewage stored in the storage tank 2 through the discharge pipe 4.

Each of the submersible pumps 5 is lowered down to a bottom of the storage tank 2 from the opening 2*b* of the storage tank 2 through a guide pipe and is installed in the storage tank 2 so as to be attachable and detachable to and from the discharge pipe 4 (drain pipe) via an attaching and detaching portion. Each of the submersible pumps 5 includes a pump main body 6 and an electric motor 7 arranged in an upper portion of the pump main body 6. The pump main body 6 is formed of, for example, a centrifugal pump. Note that the submersible pump 5 may be provided with an unillustrated oil room.

Figure 4:
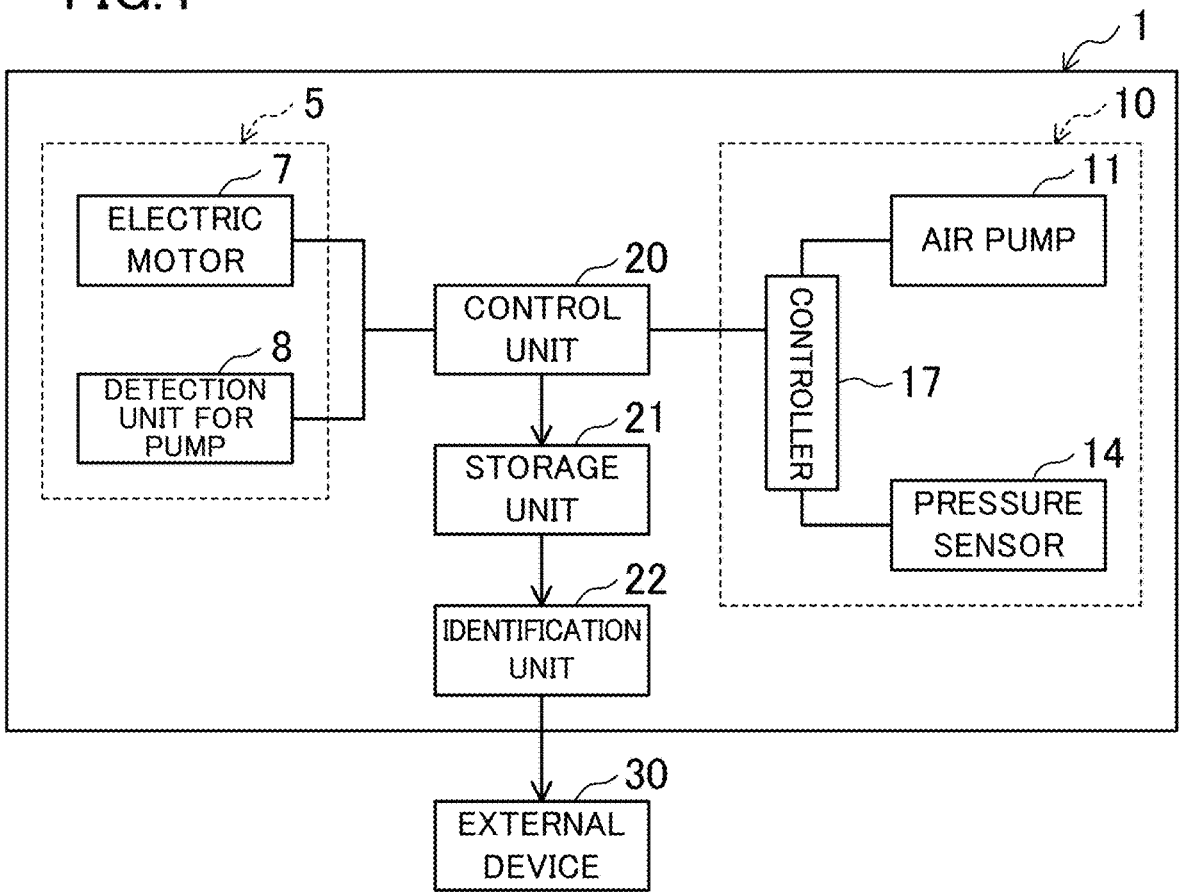
FIG. 4 is a block diagram schematically illustrating a configuration of the submersible pump system.

As illustrated in FIG. 4, each of the submersible pumps 5 includes a detection unit 8 for pump. The detection unit 8 for pump is configured to detect, for example, at least one of a water content of oil contained in an oil room in the pump main body 6, a flooded state in the electric motor 7, temperature of a bearing member forming the submersible pump 5, a value of a discharge amount (flow rate) of the sewage discharged from the pump main body 6, a pressure at which the sewage is discharged from the pump main body 6, and an oscillation value, an insulation resistance value, and winding temperature of the electric motor 7. Note that the detection unit 8 for pump may be attached to the submersible pump 5 afterwards. Alternatively, the detection unit 8 for pump may be built in the submersible pump 5.

(Water Level Detector)

As illustrated in FIG. 1 to FIG. 4, the submersible pump system 1 includes a water level detector 10. The water level detector 10 detects a water level of the sewage stored in the storage tank 2 and is configured, for example, as a bubble-type water level detector.

The water level detector 10 includes an air pump 11, an air discharge unit 12 arranged so as to be submerged in the sewage in the storage tank 2, an air tube 13 that couples the air pump 11 and the air discharge unit 12 together, a pressure sensor 14 that detects an air pressure in the air tube 13, and a controller 17.

A water gauge 16 arranged in the same storage tank 2 is a float-type water gauge and is installed in the storage tank 2 as a spare water gauge 16 that detects an abnormal water level in the storage tank 2. The controller 17 is electrically coupled to each of the air pump 11, the assembling process 14, and a control unit 20 that will be described later.

The air pump 11 and the pressure sensor 14 are configured as a water level control unit 15 and is arranged outside the storage tank 2 (see FIG. 1 and FIG. 2). The water level control unit 15 is electrically coupled to the control unit 20 that will be described later (see FIG. 4). The pressure sensor 14 transmits a measurement value of the air pressure detected in the air tube 13 to the controller 17. The controller 17 transmits water level information to the control unit 20 that will be described later.

The water level detector 10 operates in the following manner. That is, when the air pump 11 is operated by the controller 17, air is supplied from the air pump 11 to the air discharge unit 12 via the air tube 13. The air discharge unit 12 discharges the air supplied from the air pump 11 into the sewage in the storage tank 2 to generate bubbles. The pressure sensor 14 detects fluctuations of the air pressure in the air tube 13 when bubbles are generated and transmits a measured value to the controller 17. The controller 17 outputs water level information calculated from the measured value and a contact output indicating that a predetermined water level has reached to the control unit 20 that will be described later.

Note that the above-described "water level information" includes information of a water level that has been detected by the water level detector 10 since before the submersible pumps 5 were driven. That is, if the water level has been detected since before the submersible pumps 5 were driven and the water level information has been recorded, it is possible to know an inflow amount immediately before the submersible pumps 5 were driven. It is thus possible to determine whether the submersible pumps 5 were driven because of a sudden rise of the water level in the storage tank 2 or the water level in the storage tank 2 has reached a water level at which the submersible pumps 5 can be driven as a result of a gradual rise thereof. Herein, the water level detector 10 or the controller 17 of the water level detector 10 may be coupled to a storage unit 21 without via the control unit 20 and may be configured to transmit the water information directly to the storage unit 21.

(Electric Current Detection Unit)

During a driving time from a start of driving of the electric motor 7 to an end thereof in the submersible pump 5 (which will be hereinafter referred to as a "driving time"), an electric current detection unit 23 detects a drive electric current of the electric motor 7 in the submersible pump 5 (which will be hereinafter referred to as a "drive electric current") and transmits an electric current value to the storage unit 21 (see S2 illustrated in FIG. 5).

(Control Unit)

As illustrated in FIG. 4, the submersible pump system 1 includes the control unit 20. The control unit 20 is installed, for example, in a control board 9 located outside the storage tank 2 (see FIG. 1). Note that the control unit 20 includes a central processing unit (CPU), a random access memory (RAM), or the like and may be configured to read a computer program stored, for example, in the storage unit 21 to the RAM and execute the computer program on the CPU.

The control unit 20 is electrically coupled to each of the electric motor 7 and the detection unit 8 for pump that form the submersible pump 5. The control unit 20 controls driving of the electric motor 7 to start and stop an operation of the submersible pump 5 (see S1 and S4 illustrated in FIG. 5).

The control unit 20 is electrically coupled to the water level detector 10. The air pump 11 is driven at all times and supplies air to the air discharge unit 12. The control unit 20 then controls driving of the electric motor 7 in the submersible pump 5, based on a detected value of the water level in the storage tank 2 detected by the water level detector 10.

When the water level detected by the water level detector 10 becomes a predetermined start water level (see a position of H illustrated in FIG. 3) or more while the submersible pump 5 is stopped, the control unit 20 performs control such that the electric motor 7 of the submersible pump 5 is driven. Thus, the sewage in the storage tank 2 is drained to outside by the submersible pump 5 and the water level of the storage tank 2 is lowered.

On the other hand, when the water level detected by the water level detector 10 becomes a predetermined stop water level (see a position of L illustrated in FIG. 3) or less while the submersible pump 5 is in operation, the control unit 20 performs control to stop driving of the electric motor 7. Thus, pumping up (draining) of water by the submersible pump 5 ends. Thereafter, sewage flowing in the storage tank 2 from the outside through the inflow pipe 3 is stored in the storage tank 2 again. The control unit 20 may be configured to transmit the water information transmitted from the water level detector 10 and a drive electric current value detected by the electric current detection unit 23 to the storage unit 21.

(Storage Unit)

As illustrated in FIG. 4, the submersible pump system 1 includes the storage unit 21. The storage unit 21 may be configured, for example, as a portion of a server device on a cloud, may be configured as a single device embedded in the control board 9, and may be provided in any location on an information route from the water level detector 10 or the electric current detection unit 23 to an identification unit 22.

The storage unit 21 can transmit and receive various types of data to and from the control unit 20. The storage unit 21 records, for example, a time when each of operations of the submersible pumps 5 is started, a time when each of the operations of the submersible pumps 5 is sopped, or the like.

Figure 5:
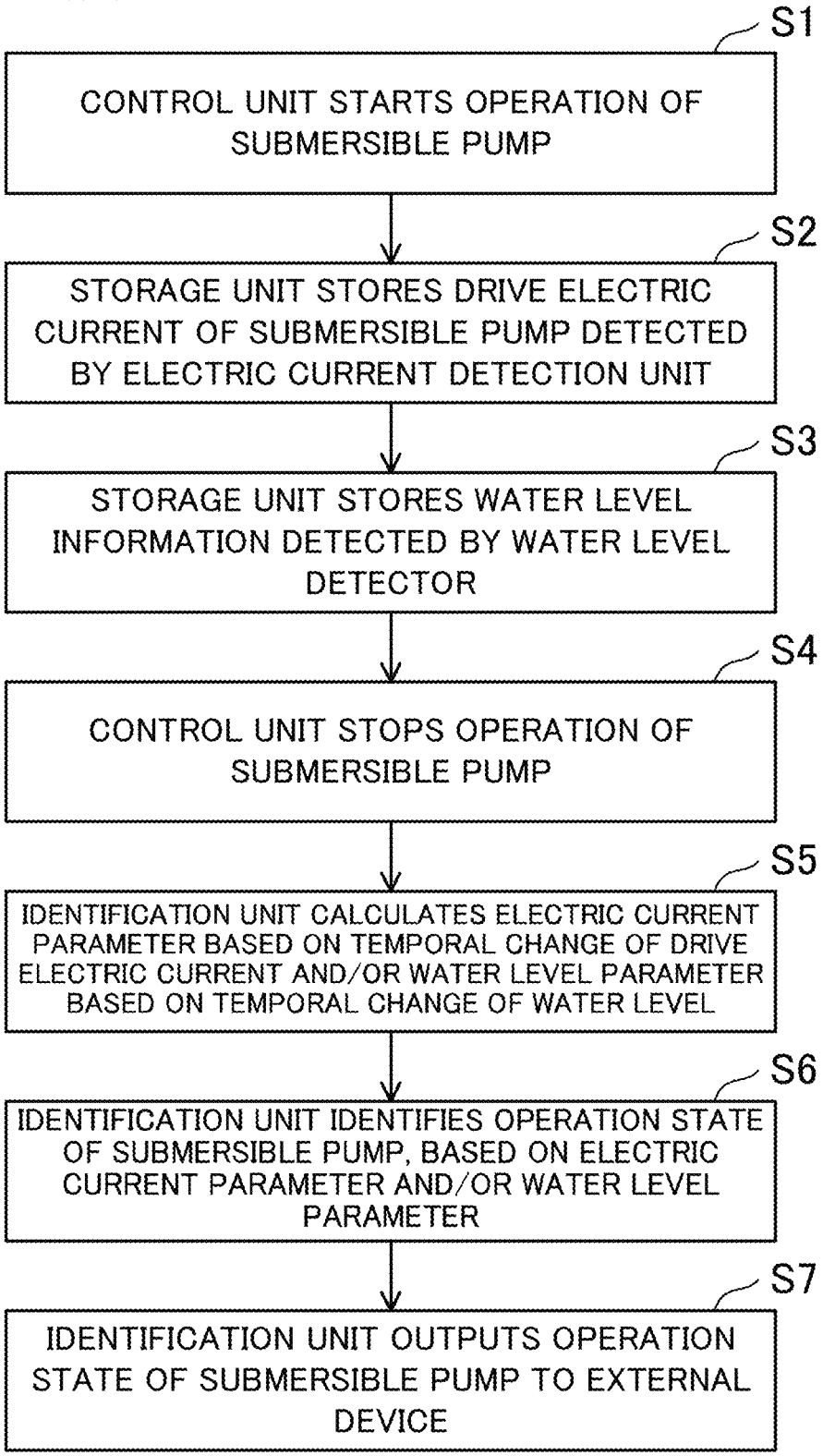
FIG. 5 is a flowchart schematically illustrating a series of operations performed in the submersible pump system.

The storage unit 21 stores the drive electric current value of each of the submersible pumps 5 detected by the electric current detection unit 23 (see S2 illustrated in FIG. 5). Furthermore, the storage unit 21 is configured to store temporal change of the drive electric current.

Moreover, the storage unit 21 stores the water level information detected by the water level detector 10 (the water level information received from the control unit 20 or the water level detector 10) in association with a time from a start of an operation of each of the submersible pumps to detection of the individual water level value of the submersible pump (see S3 illustrated in FIG. 5). Furthermore, the storage unit 21 is configured to store temporal change of the water level detected by the water level detector 10.

(Identification Unit)

As illustrated in FIG. 4, the submersible pump system 1 includes the identification unit 22. The identification unit 22 is configured, for example, as a portion of the server device on the cloud. The identification unit 22 can transmit and receive various types of data to and from an external device 30, such as a personal computer, a mobile phone, or the like. Note that the identification unit 22 may be a device embedded in the control board 9 forming the control unit 20 and may be integrally configured with the storage unit 21.

As a characteristic of the submersible pump system 1, the identification unit 22 is configured to calculate at least one electric current parameter of a plurality of electric current parameters based on the temporal change of the drive electric current (see S5 illustrated in FIG. 5) and identify an operation state indicating whether there is an abnormality in the submersible pump 5 and a type of an abnormal operation (which will be hereinafter simply referred to as an "operation state"), based on the electric current parameter (see S6 illustrated in FIG. 5).

Also, the identification unit 22 is configured to calculate at least one water level parameter of a plurality of water level parameters based on the temporal change of the water level (see S5 illustrated in FIG. 5) and identify the operation state of the submersible pump 5, based on the water level parameter and the above-described electric current parameter (see S6 illustrated in FIG. 5).

Furthermore, the identification unit 22 is configured to calculate at least one water level parameter of the plurality of water level parameters based on the temporal change of the water level (see S5 illustrated in FIG. 5) and identify the operation state of the submersible pump 5, based on the water level parameter (see S6 illustrated in FIG. 5).

Examples of the "plurality of electric current parameters" include, for example, a standard deviation of the drive electric current during the driving time, a maximum value and a minimum value of the drive electric current, a ratio between the maximum value and the minimum value of the drive electric current, a change amount of the drive electric current per unit time, a total number of electric current change points, that is, points at which a degree of the temporal change of the drive electric current changed, during the driving time, a time from a start of an operation of the submersible pump 5 to an electric current change point, and a time from the electric current change point to an end of the operation.

Examples of the "plurality of water parameters" include, for example, a maximum value of water level speed and a total number of water level change points when a degree of the temporal change of the water level changed during the driving time.

The "standard deviation of the drive electric current" may be calculated by sampling the electric current value of the electric motor 7 after driving the submersible pump 5 installed in a predetermined pump station or may be calculated based on operation result data of the submersible pump 5 obtained in past or operation result data of the submersible pump 5 installed in some other pump station than the predetermined pump station (which will be hereinafter referred to as "some other pump station"). As the "operation result data of the submersible pump obtained in past," a normal operation cycle, an operation time zone, a characteristic for each day of week, or the like can be obtained from an operation result of the submersible pump 5 in the predetermined pump station in past to be used for failure (abnormality) determination. Note that, as a method for obtaining the operation result data of the submersible pump 5 installed in some other pump station, for example, the operation result data may be obtained by downloading the operation result data from the server device on the cloud or may be obtained in a form in which the operation result data is stored in a memory medium, such as a USB memory or the like, when the submersible pump 5 installed in some other pump station or the like is maintained.

The "electric current change point" is a time point at which the degree of the temporal change of the drive electric current changes. For example, the electric current change point is a time point at which the drive electric current value sharply increases or reduces from a predetermined value, a time point at which a change trend of the drive electric current value changes from an increase trend to a reduction trend with a lapse of time, a time point at which the change trend of the drive electric current value changes from an increase trend to a reduction trend with a lapse of time, and a time point at which an increase trend and a reduction trend of the drive electric current value sharply change with a lapse of time (see FIG. 16, FIG. 18, FIG. 20, and FIG. 22).

The "water level change point" is a time point at which the degree of the temporal change of the water level changes. For example, the water level change point is a time point at which the water level value sharply increases or reduces from a predetermined value, a time point at which a change trend of the water level value changes from an increase trend to a reduction with a lapse of time, a time point at which the change trend of the water level value changes from a reduction trend to an increase trend with a lapse of time, and a time point at which an increase trend and a reduction trend of the water level value sharply change with a lapse of time (see FIG. 15 and FIG. 25).

Incidentally, the identification unit 22 may be configured to predict a future operation state from the operation state of the submersible pump 5. Also, the identification unit 22 may be configured to predict a future operation state of the submersible pump 5 from both of the operation state of the submersible pump 5 and a detection result of the detection unit 8 for pump. Furthermore, the control unit 20 may be configured to, based on the operation states of two submersible pumps 5 identified by the identification unit 22, perform control such that one of the submersible pumps 5 that has been determined to be highly likely in an abnormal state is stopped to be driven only at emergency.

(Learning Control of Identification Unit)

In this embodiment, the identification unit 22 includes an artificial intelligence (AI) function. The identification unit 22 is configured to, in order to identify the operation state of the submersible pump 5 with high accuracy, learn to set a virtual boundary that divides the operation state of the submersible pump 5 using the electric current parameter and/or the water level parameter, for example, based on the operation result of the submersible pump 5. Note that the "operation result of the submersible pump 5" is not limited to the operation result of the submersible pump 5 obtained in a single pump station, and refers to as operation results of the submersible pumps 5 obtained in many specified pump stations.

Specifically, as illustrated in FIG. 6 to FIG. 14, the identification unit 22 is configured to execute learning control in which a virtual boundary is set based on first to ninth combinations achieved by arbitrarily combining one or more electric current parameters and/or one or more water level parameters. Note that, although, in each of FIG. 6 to FIG. 14, the boundary is represented by a rectangle, the boundary is not limited to a straight line or a combination of straight lines and may be a curved line. The learning control of the identification unit 22 will be specifically described with reference to FIG. 6 to FIG. 14.

Note that, in learning control, the control unit 20 may be configured to determine a boundary using a support vector machine, a decision tree, a machine learning method, such as clustering, or the like and specify the above-described operation state. The operation state may be specified by deep learning. In this case, by using, as input data of training data, at least one of time-series data of the electric current value, time-series data of the water level, the standard deviation of the electric current, the maximum value and the minimum value of the electric current, the ratio between the maximum value and the minimum value of the drive electric current, the change amount of the electric current per unit time, the total number of the electric current change points, the total number of the water level change points, and the water level speed, a label indicating a normal state, foreign object passing, an over-capacity inflow, an airlock, or the like may be given as output data. The control unit 20 performs tuning of parameters of a learning model by back propagation using a large amount of training data that has been already measured. The control unit 20 can specify the operation state by setting a leaning model after learning in the identification unit 22.

In the following description, the "airlock" is a state where the submersible pump 5 cannot pump up water because the submersible pump 5 was operated with air remaining in the pump main body 6. An "idle operation" is a state where the submersible pump 5 cannot pump up water because air entered in the pump main body 6 during an operation of the submersible pump 5. The "foreign object passing" is a state where some kind of foreign object that has stayed in the pump main body 6 flows out to outside of the pump main body 6. "Foreign object blockage" is a state where some kind of foreign object flowed in the pump main body 6 and blocks in the pump main body 6. "Foreign object staying" is a state where some kind of foreign object stays in the pump main body 6 of the submersible pump 5. The "over-capacity inflow" is a state where sewage an amount of which exceeds, for example, a planned drainage amount for the submersible pumps 5 flowed in the storage tank 2 and a water level of the sewage in the storage tank 2 is not stably lowered or a state where, even when the inflow amount in the storage tank 2 is in an assumed range, drainage processing of the submersible pumps 5 cannot keep up with inflow of the sewage because a drainage capacity of the submersible pumps 5 has been reduced. An "excessive inflow" is a state where sewage of an amount exceeding an inflow amount that is assumed in the storage tank 2 (which will be hereinafter referred to as an "assumed inflow amount") flowed in the storage tank 2 due to an external factor, such as, for example, heavy rain, or the like As for notes indicated in FIG. 6 to FIG. 14, "◇ marks" (white blank diamond-shaped marks) indicate not only the "foreign object passing" but also the "foreign object blockage" and the "foreign object staying." Also, "Δ marks" (triangular marks) indicates not only the "over-capacity inflow" but also the "excessive inflow."

Figure 6:
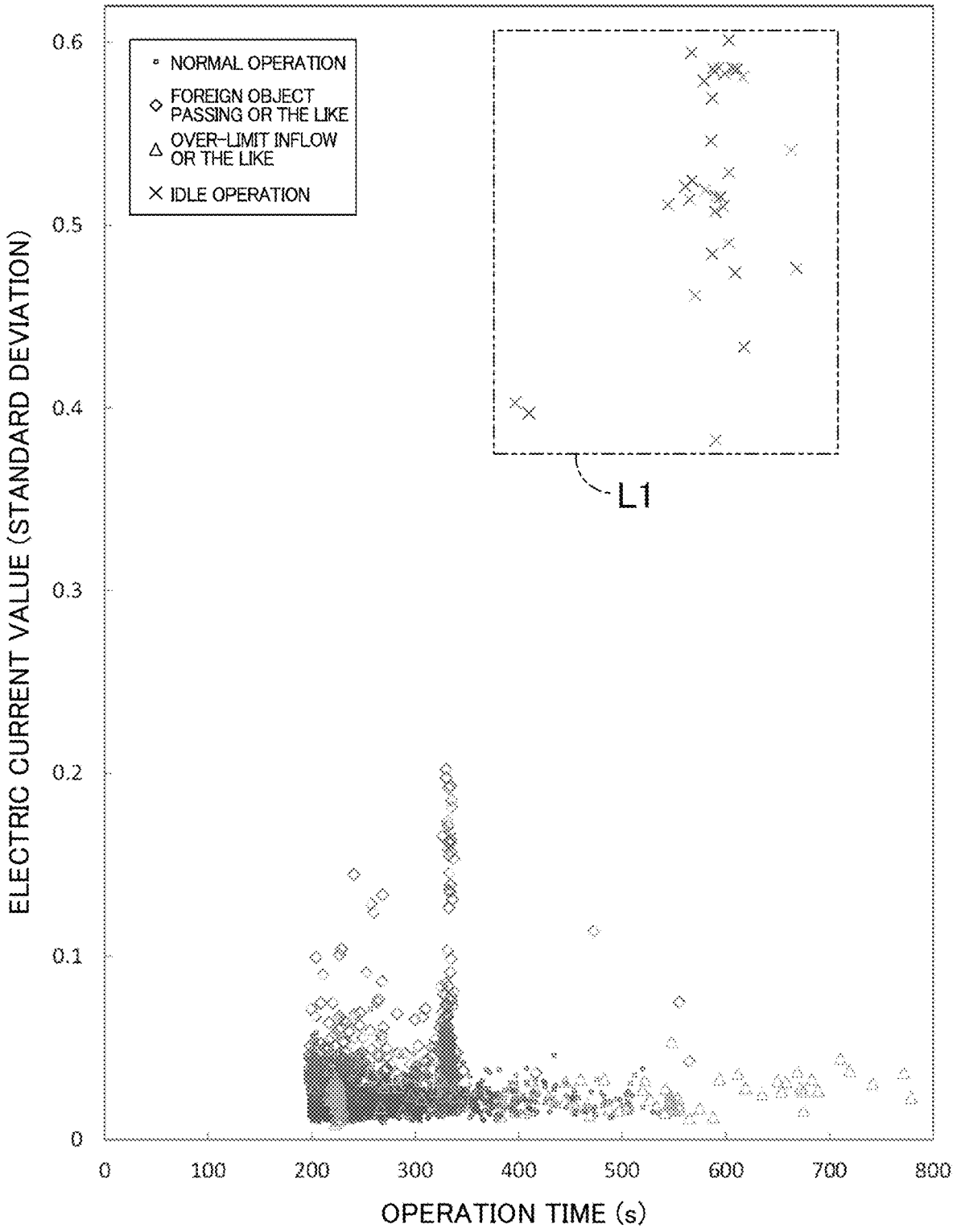
FIG. 6 is a graph illustrating a first combination.

The first combination illustrated in FIG. 6 illustrates a case where the ordinate is set to be an "electric current value (standard deviation)" as an electric current parameter and the abscissa is set to be an "operation time (s) of a submersible pump."

In the first combination, for a group of data obtained when a so-called "idle operation" occurred, there is a trend that the "electric current value (standard deviation)" exceeds about 0.4 at and after a time point at which an operation time of the submersible pumps 5 exceeds about 400 s. That is, for the first combination, a boundary L1 is set to divide the idle operation from the other types of abnormal operation (the foreign object passing, the foreign object blockage, and the over-capacity inflow).

Figure 7:
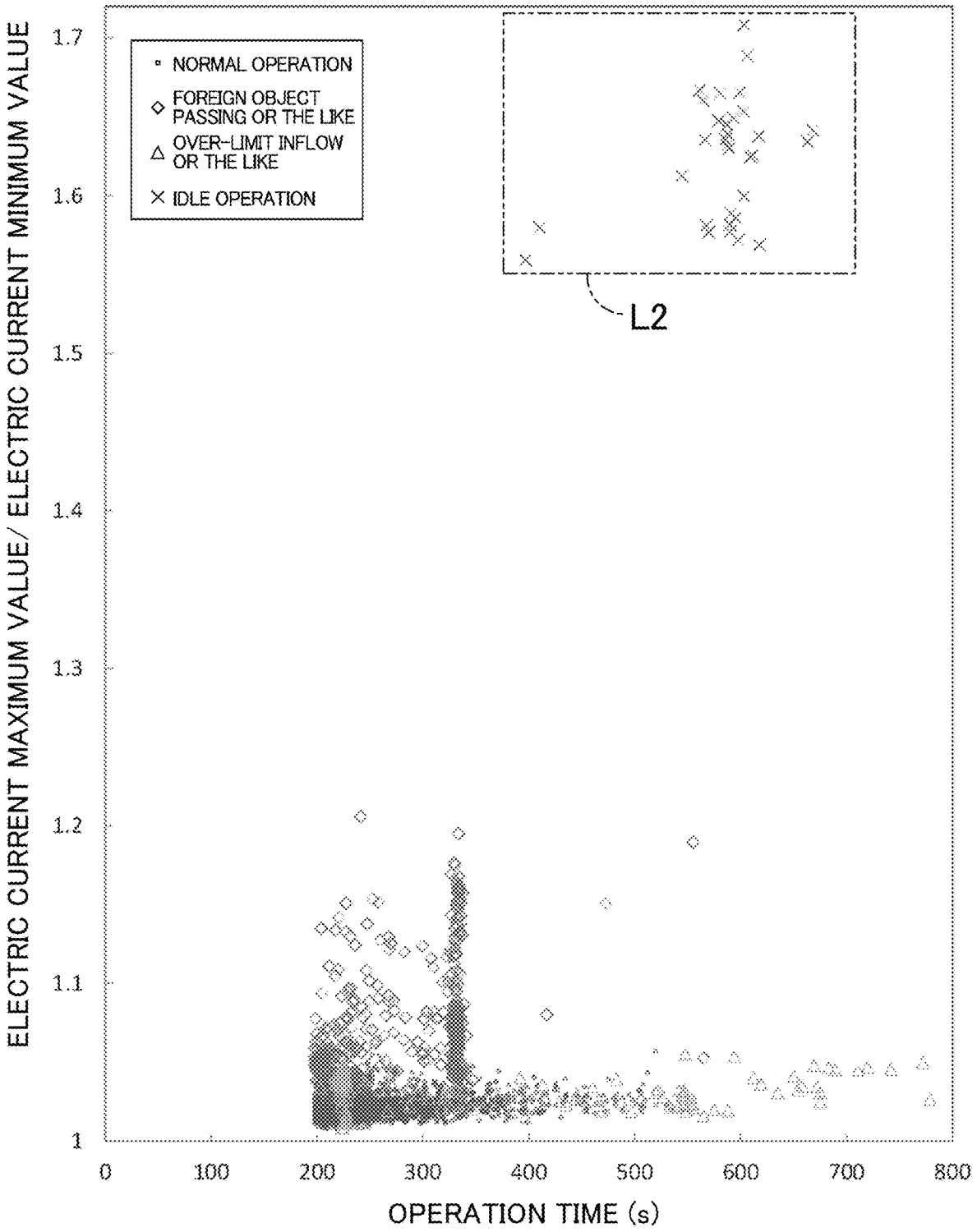
FIG. 7 is a graph illustrating a second combination.

The second combination illustrated in FIG. 7 illustrates a case where the ordinate is set to be the "ratio between the maximum value and the minimum value of the drive electric current" as an electric current parameter and the abscissa is set to be the "operation time (s) of a submersible pump."

In the second combination, for a group of data obtained when the "idle operation" occurred, there is a trend that the ratio between the maximum value and the minimum value of the drive electric current exceeds 1.55 at and after a time point at which the operation time of the submersible pumps 5 exceeds about 400 s. That is, for the second combination, a boundary L2 is set to divide the idle operation from the other types of abnormal operation.

Figure 8:
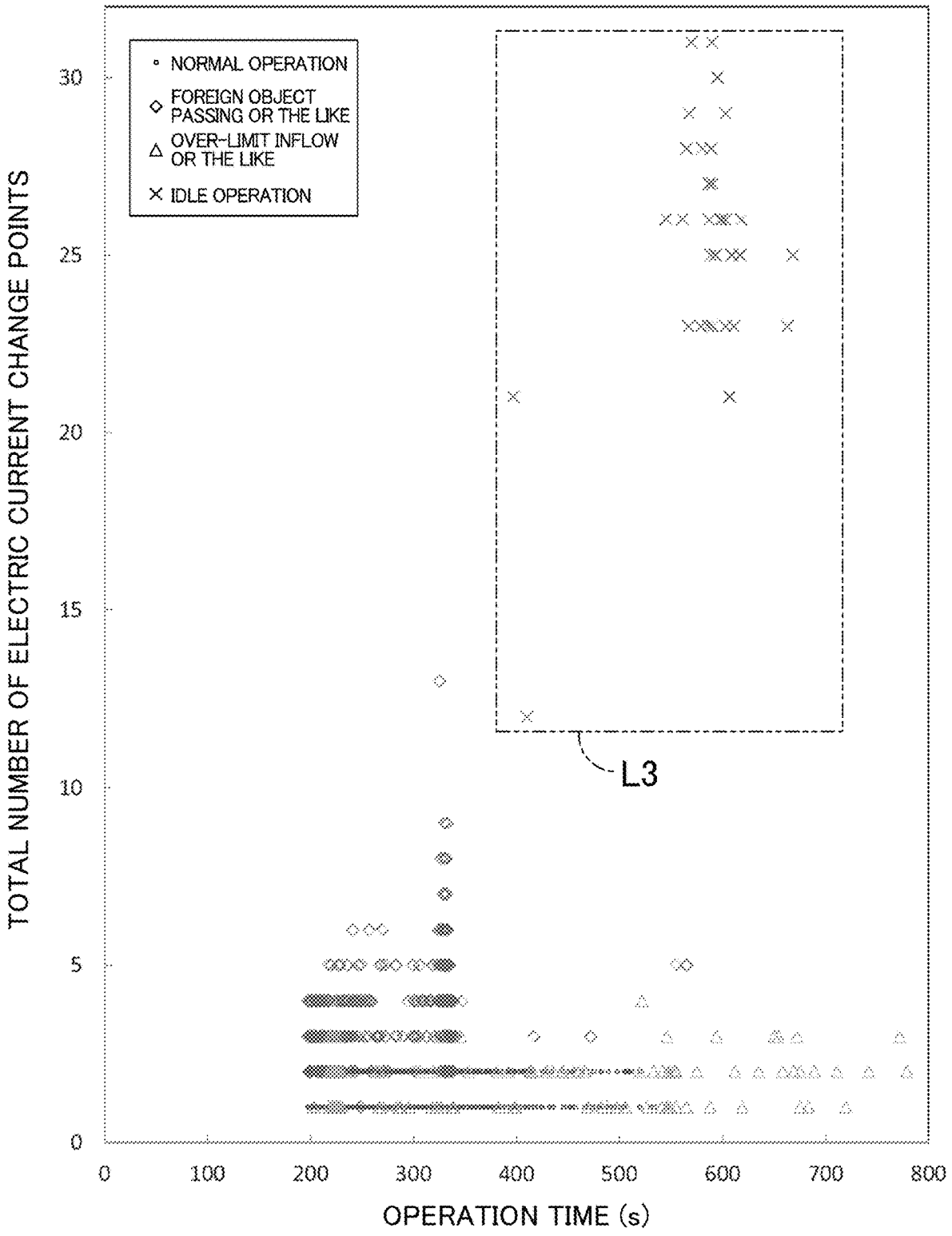
FIG. 8 is a graph illustrating a third combination.

The third combination illustrated in FIG. 8 illustrates a case where the ordinate is set to be the "total number of electric current change points" as an electric current parameter and the abscissa is set to be the "operation time (s) of a submersible pump."

In the third combination, for a group of data obtained when the "idle operation" occurred, there is a trend that the "total number of electric current change points" exceeds 12 at an after a time point at which the operation time of the submersible pumps 5 exceeds about 400 s. That is, for the third combination, a boundary L3 is set to divide the idle operation from the other types of abnormal operation.

As described above, in accordance with the first to third combinations, the boundaries can be set to divide the idle operation from the other types of abnormal operation (the foreign object passing, the foreign object blockage, and the over-capacity inflow) by using one electric current parameter of the plurality of electric current parameters.

Figure 9:
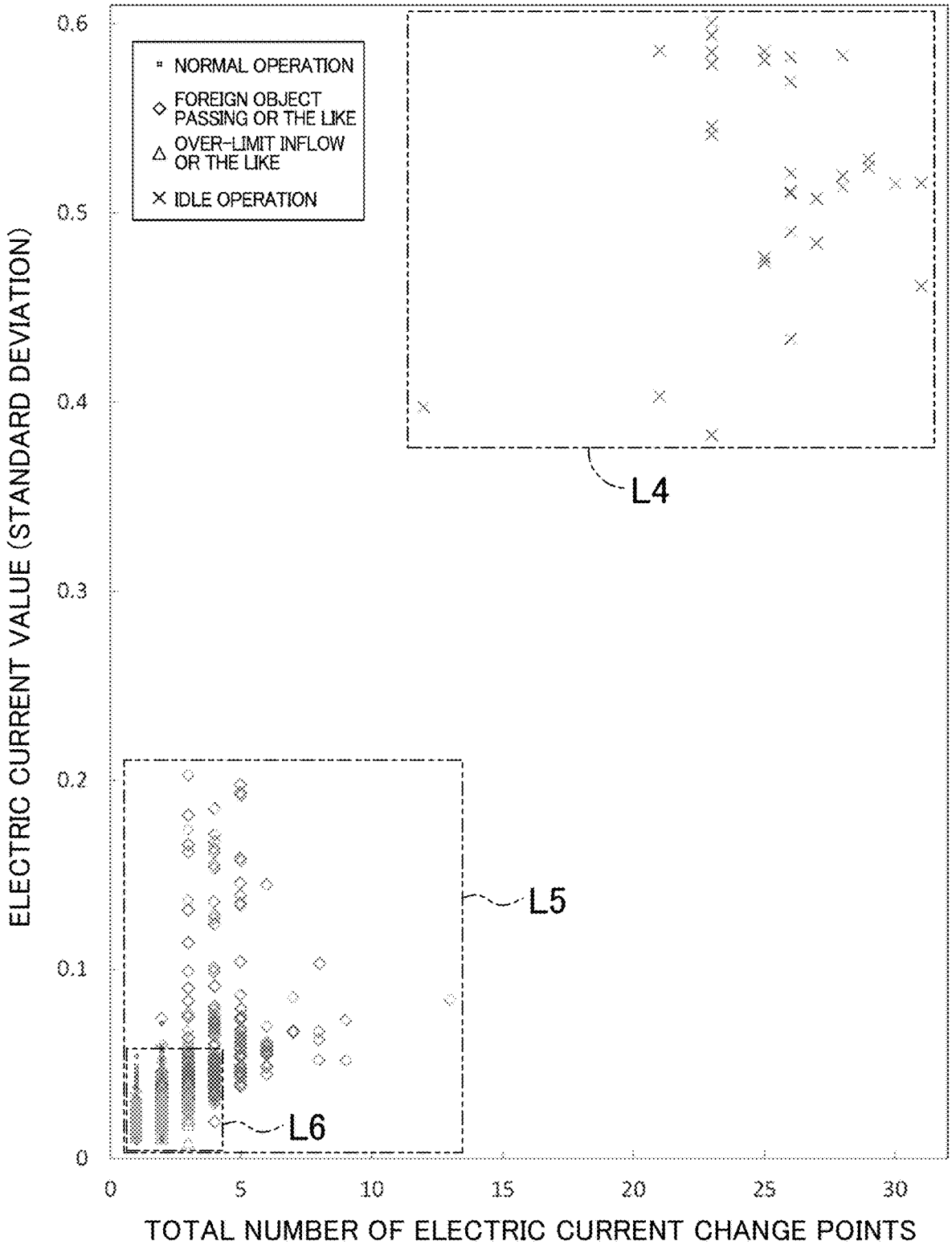
FIG. 9 is a graph illustrating a fourth combination.

Next, the fourth combination illustrated in FIG. 9 illustrates a case where the ordinate is set to be the "electric current value (standard deviation)" as an electric current parameter and the abscissa is set to be the "total number of electric current change points" as an electric current parameter.

In the fourth combination, for a group of data obtained when the "idle operation" occurred, there is a trend that the "electric current value (standard deviation)" falls in a range of about 0.38 to 0.6 when the "total number of electric current change points" is in a range of 12 to 31. That is, for the fourth combination, a boundary L4 is set to divide the idle operation from the other types of abnormal operation.

Moreover, in the fourth combination, for a group of data obtained when the "foreign object passing and the foreign object blockage" occurred, there is a trend that the "electric current value (standard deviation)" falls in a range of 0.01 to 0.2 when the "total number of electric current change points" is in a range of 1 to 13. That is, for the fourth combination, a boundary L5 is set to divide the foreign object passing and the foreign object blockage from the other types of abnormal operation.

Furthermore, in the fourth combination, for a group of data obtained when the "over-capacity inflow" occurred, there is a trend that the "electric current value (standard deviation)" falls in a range of 0.01 to 0.07 when the "total number of electric current change points" is in a range of 1 to 4. That is, for the fourth combination, a boundary L6 is set to divide the over-capacity inflow from the other types of abnormal operation.

As described above, in accordance with the third and fourth combinations, the boundaries can be set to divide the idle operation, the foreign object passing and the foreign object blockage, and the over-capacity inflow from one another by using two electric current parameters of the plurality of electric current parameters.

Figure 10:
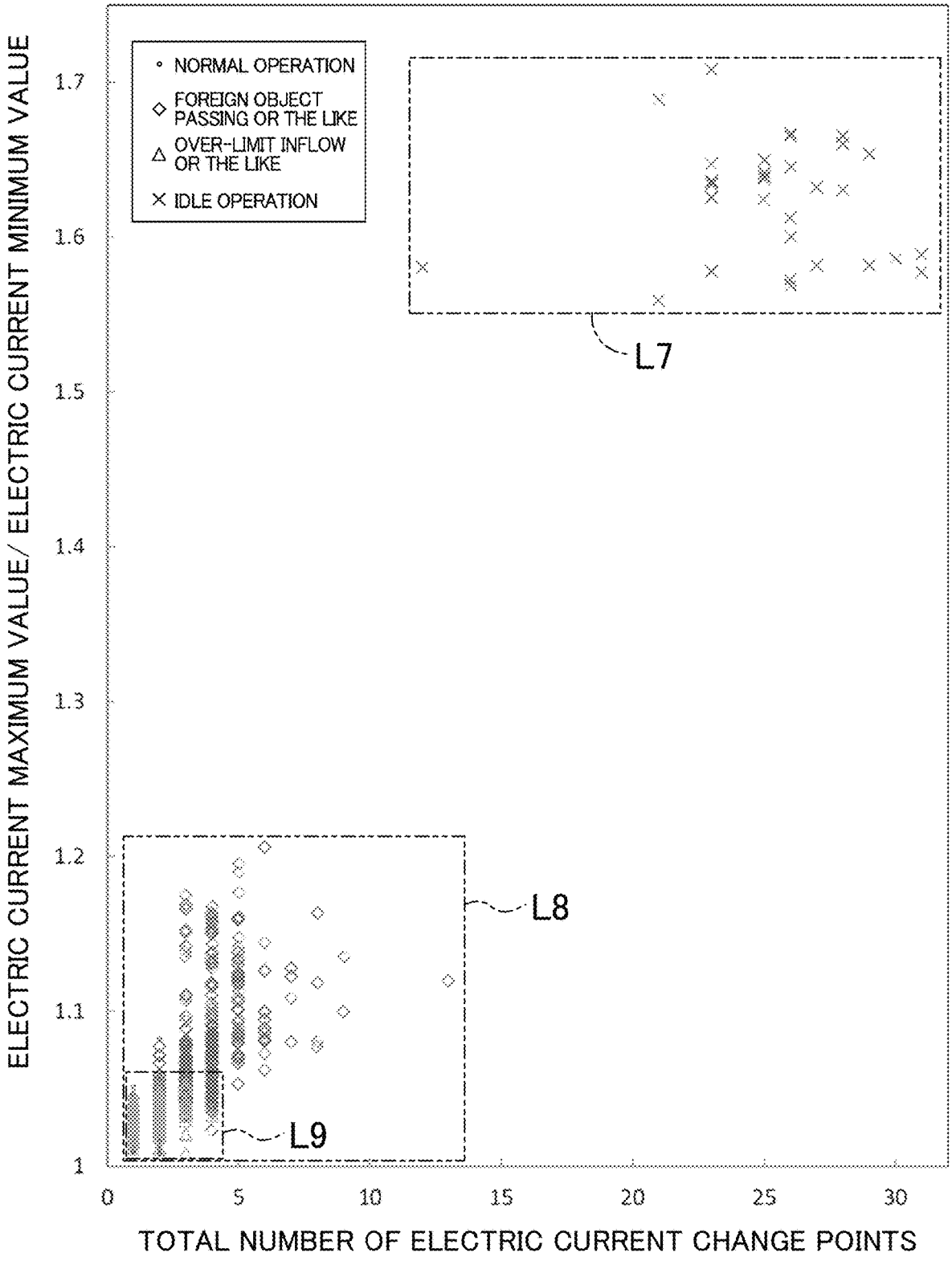
FIG. 10 is a graph illustrating a fifth combination.

The fifth combination illustrated in FIG. 10 illustrates a case where the ordinate is set to be the "ratio between the maximum value and the minimum value of the drive electric current" as an electric current parameter and the abscissa is set to be the "total number of electric current change points" as an electric current parameter.

In the fifth combination, for a group of data obtained when the "idle operation" occurred, there is a trend that the "ratio between the maximum value and the minimum value of the drive electric current" falls in a range of about 1.55 to 1.7 when "the total number of electric current change points" is in a range of 12 to 31. That is, for the fifth combination, a boundary L7 is set to divide the idle operation from the other types of abnormal operation.

Moreover, in the fifth combination, for a group of data obtained when the "foreign object passing and the foreign object blockage" occurred, there is a trend that the "ratio between the maximum value and the minimum value of the drive electric current" falls in a range of 1.0 to 1.2 when the "total number of electric current change points" is in a range of 1 to 13. That is, for the fifth combination, a boundary L8 is set to divide the foreign object passing and the foreign object blockage from the other types of abnormal operation.

Furthermore, in the fifth combination, for a group of data obtained when the "over-capacity inflow" occurred, there is a trend that the "ratio between the maximum value and the minimum value of the drive electric current" falls in a range of 1.00 to 1.05 when the "total number of electric current change points" is in a range of 1 to 4. That is, for the fifth combination, a boundary L9 is set to divide the over-capacity inflow from the other types of abnormal operation.

Figure 11:
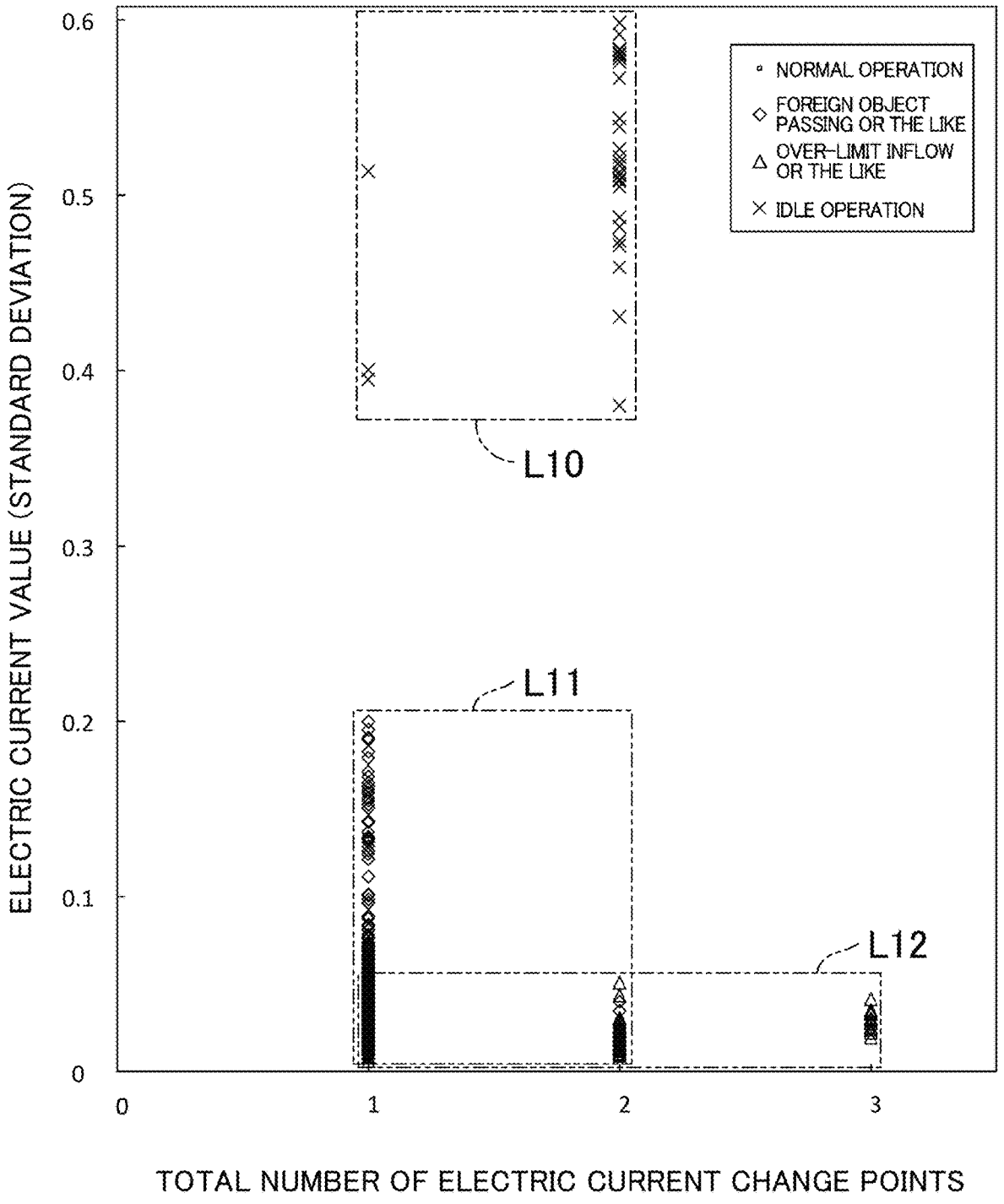
FIG. 11 is a graph illustrating a sixth combination.

The sixth combination illustrated in FIG. 11 illustrates a case where the ordinate is set to be the "electric current value (standard deviation)" as an electric current parameter and the abscissa is set to be the "total number of water level change points" as a water level parameter.

In the sixth combination, for a group of data obtained when the "idle operation" occurred, there is a trend that the "electric current value (standard deviation)" falls in a range of about 0.37 to 0.6 when the "total number of water level change points" is in a range of 1 to 2. That is, for the sixth combination, a boundary L10 is set to divide the idle operation from the other types of abnormal operation.

Moreover, in the sixth combination, for a group of data obtained when the "foreign object passing and the foreign object blockage" occurred, there is a trend that the "electric current value (standard deviation)" falls in a range of 0.01 to 0.2 when the "total number of water level change points" is in a range of 1 to 2. That is, for the sixth combination, a boundary L11 is set to divide the foreign object passing and the foreign object blockage from the other types of abnormal operation.

Furthermore, in the sixth combination, for a group of data obtained when the "over-capacity inflow" occurred, there is a trend that the "electric current value (standard deviation)" falls in a range of 0.01 to 0.05 when the "total number of electric current change points" is in a range of 1 to 3. That is, for the sixth combination, a boundary L12 is set to divide the over-capacity inflow from the other types of abnormal operation.

Figure 12:
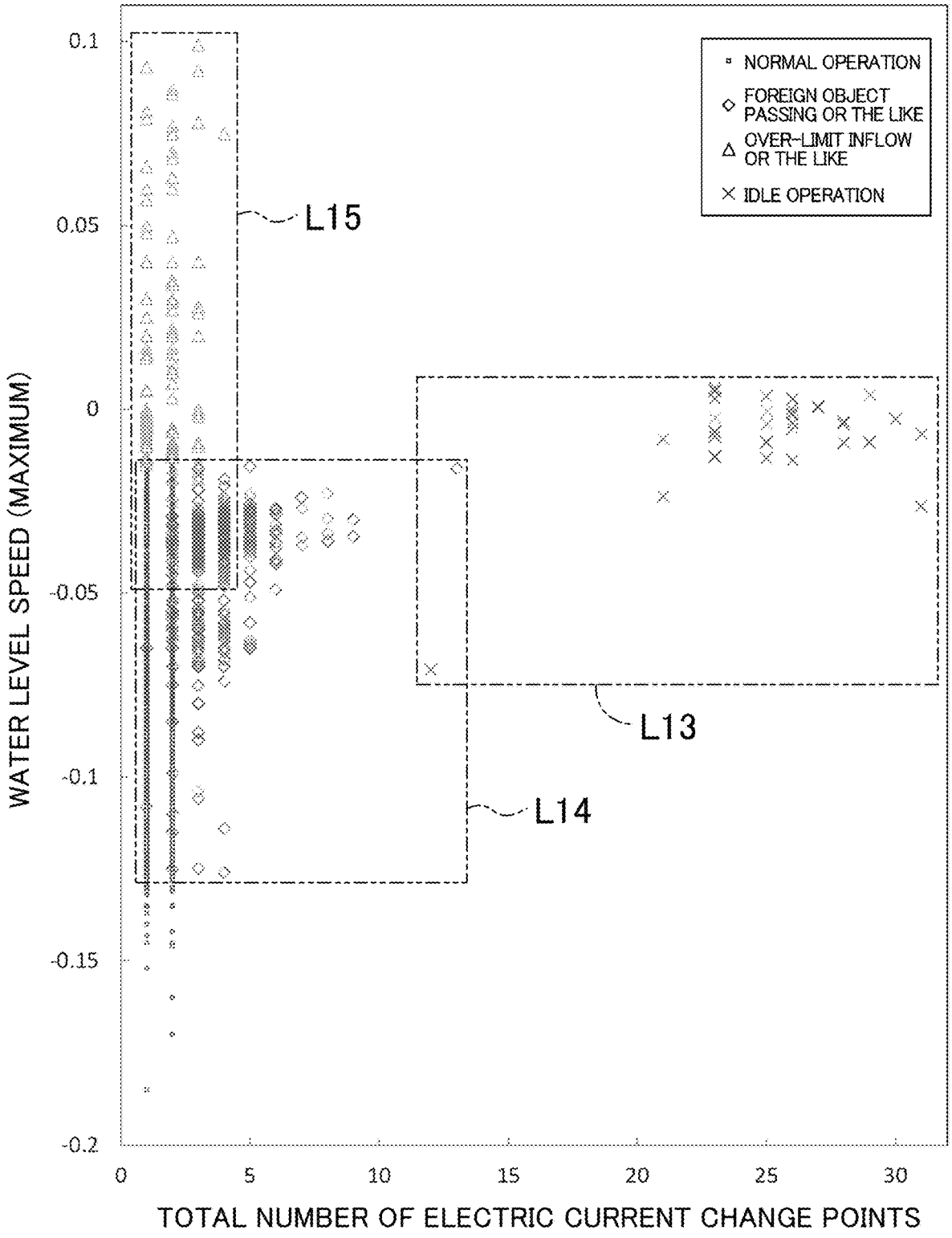
FIG. 12 is a graph illustrating a seventh combination.

The seventh combination illustrated in FIG. 12 illustrates a case where the ordinate is set to be set to be the "water level speed (maximum)" as a water level parameter and the abscissa is set to be the "total number of electric current change points" as an electric current parameter. Note that, in a case where the water level speed is a positive value, rising of the water level is indicated, while in a case where the water level speed is a negative value, lowering of the water level is indicated. Herein, a maximum value of the water level speed during a driving time is the "water level speed (maximum)."

In the seventh combination, for a group of data obtained when the "idle operation" occurred, there is a trend that the "water level speed (maximum)" falls in a range of about negative 0.07 to 0.01 when the "total number of electric current change points" is in a range of 12 to 31. That is, for the seventh combination, a boundary L13 is set to divide the idle operation from the other types of abnormal operation.

Moreover, in the seventh combination, for a group of data obtained when the "foreign object passing and the foreign object blockage" occurred, there is a trend that the "water level speed (maximum)" falls in a range of negative 0.13 to negative 0.02 when the "total number of electric current change points" is in a range of 1 to 13. That is, for the seventh combination, a boundary L14 is set to divide the foreign object passing and the foreign object blockage from the other types of abnormal operation.

Furthermore, in the seventh combination, for a group of data obtained when the "over-capacity inflow" occurred, there is a trend that the "water level speed (maximum)" falls in a range of negative 0.05 to 0.1 when the "total number of electric current change points" is in a range of 1 to 4. That is, for the seventh combination, a boundary L15 is set to divide the over-capacity inflow from the other types of abnormal operation.

Figure 13:
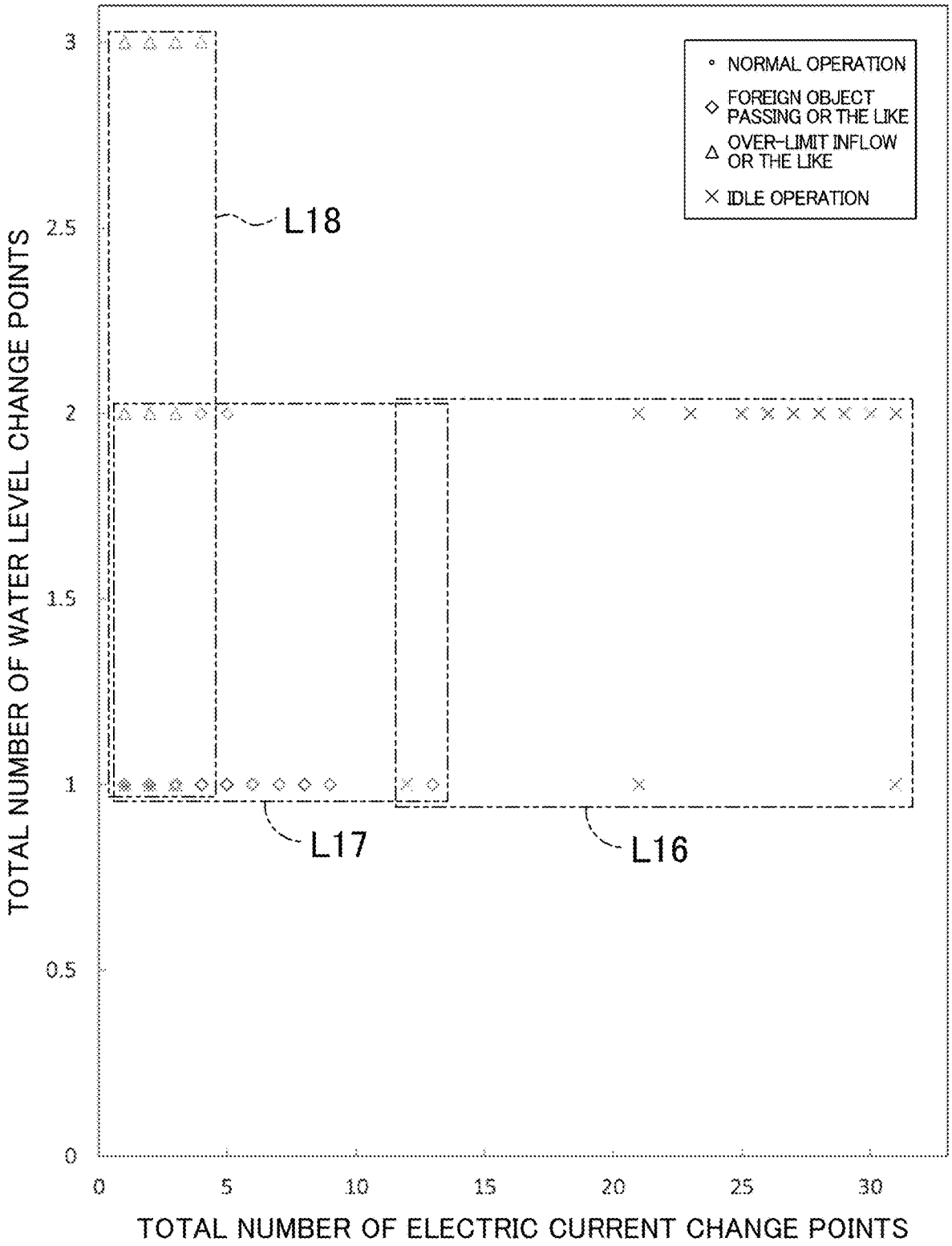
FIG. 13 is a graph illustrating an eighth combination.

The eighth combination illustrated in FIG. 13 illustrates a case where the ordinate is set to be set to be the "total number of water level change points" as a water level parameter and the abscissa is set to be the "total number of electric current change points" as an electric current parameter.

In the eighth combination, for a group of data obtained when the "idle operation" occurred, there is a trend that the "total number of water level change points" falls in a range of about 1 to 2 when the "total number of electric current change points" is in a range of 12 to 31. That is, for the eighth combination, a boundary L16 is set to divide the idle operation from the other types of abnormal operation.

In the eighth combination, for a group of data obtained when the "foreign object passing and the foreign object blockage" occurred, there is a trend that the "total number of water level change points" falls in a range of 1 to 2 when the "total number of electric current change points" is in a range of 1 to 13. That is, for the eighth combination, a boundary L17 is set to divide the foreign object passing and the foreign object blockage from the other types of abnormal operation.

Furthermore, in the eighth combination, for a group of data obtained when the "over-capacity inflow" occurred, there is a trend that the "total number of water level change points" falls in a range of 1 to 4 when the "total number of electric current change points" is in a range of 1 to 3. That is, for the eighth combination, a boundary L18 is set to divide the over-capacity inflow from the other types of abnormal operation.

As described above, in accordance with the fourth to eighth combinations, the boundaries can be set to divide the idle operation, the foreign object passing and the foreign object blockage, and the over-capacity inflow from one another by using one electric current parameter of the plurality of electric current parameters and one water level parameter of the plurality of water level parameters in combination.

Figure 14:
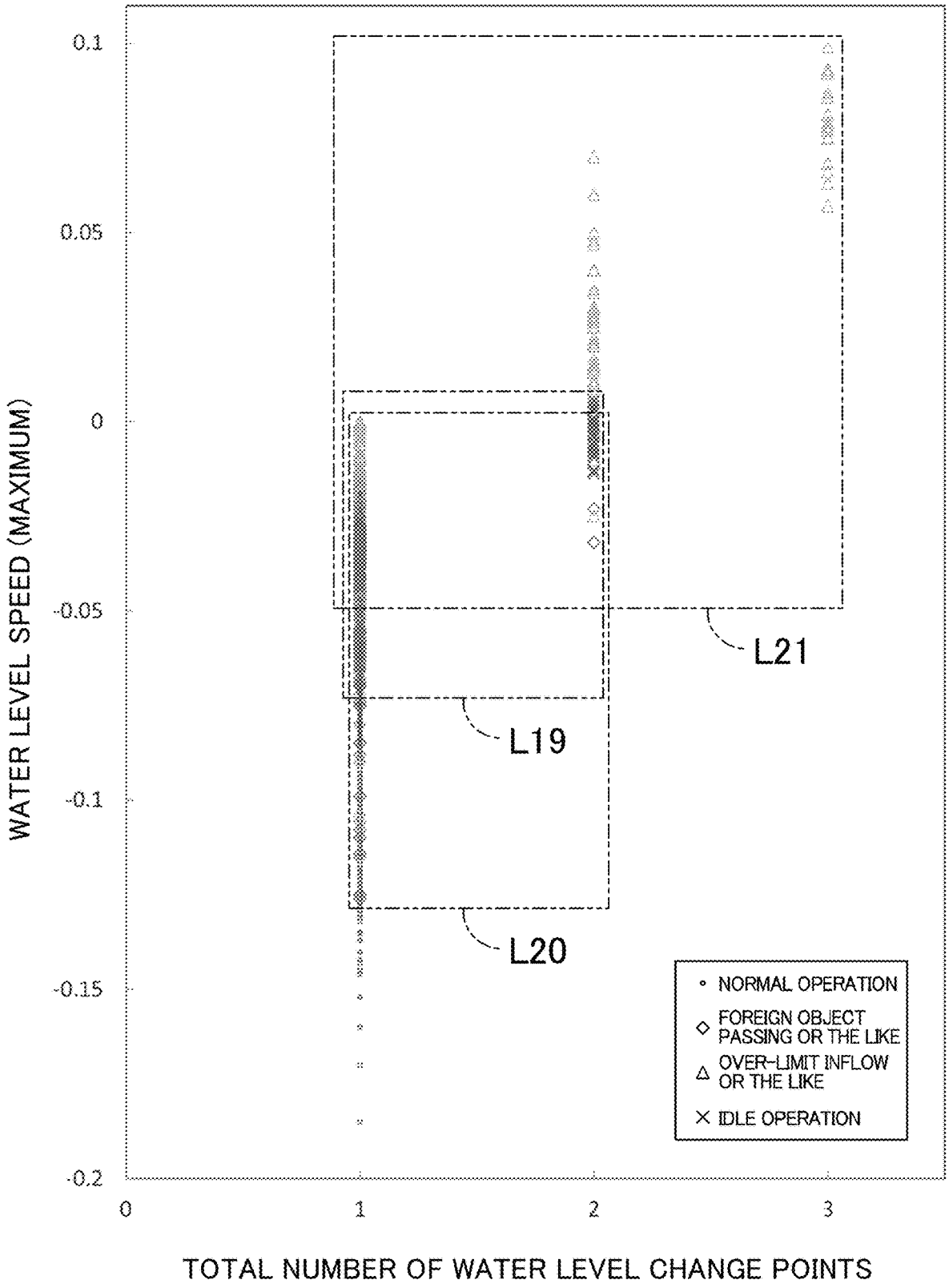
FIG. 14 is a graph illustrating a ninth combination.

The ninth combination illustrated in FIG. 14 illustrates a case where the ordinate is set to be set to be the "water level speed (maximum)" as a water level parameter and the abscissa is set to be the "total number of water level change points" as a water level parameter.

In the ninth combination, for a group of data obtained when the "idle operation" occurred, there is a trend that the "water level speed (maximum)" falls in a range of about negative 0.07 to 0.01 when the "total number of water level change points" is in a range of 1 to 2. That is, for the ninth combination, a boundary L19 is set to divide the idle operation from the other types of abnormal operation.

Moreover, in the ninth combination, for a group of data obtained when the "foreign object passing and the foreign object blockage" occurred, there is a trend that the "water level speed (maximum)" falls in a range of negative 0.13 to negative 0.02 when the "total number of water level change points" is in a range of 1 to 2. That is, for the ninth combination, a boundary L20 is set to divide the foreign object passing and the foreign object blockage form the other types of abnormal operation.

Furthermore, in the ninth combination, for a group of data obtained when the "over-capacity inflow" occurred, there is a trend that the "water level speed (maximum)" falls in a range of negative 0.05 to 0.1 when the "total number of water level change points" is in a range of 1 to 3. That is, for the ninth combination, a boundary L21 is set to divide the over-capacity inflow from the other types of abnormal operation.

As described above, in accordance with the ninth combination, the boundaries can be set to divide the idle operation, the foreign object passing and the foreign object blockage, and the over-capacity inflow from one another by using two water level parameters.

(Identification Mode of Identification Unit)

Next, identification modes of the identification unit 22 will be specifically described using first to seventh measurement examples (see FIG. 15 to FIG. 28). Note that, in each of FIG. 15, FIG. 17, FIG. 19, FIG. 21, FIG. 23, FIG. 25, and FIG. 27, the abscissa indicates the driving time of the electric motor 7 in the submersible pump 5 and the ordinate indicates the water level in the storage tank 2. In each of FIG. 16, FIG. 18, FIG. 20, FIG. 22, FIG. 24, FIG. 26, and FIG. 28, the abscissa indicates the driving time of the electric motor 7 and the ordinate indicates the drive electric current (A: ampere) of the electric motor 7.

FIRST MEASUREMENT EXAMPLE

Figure 15:
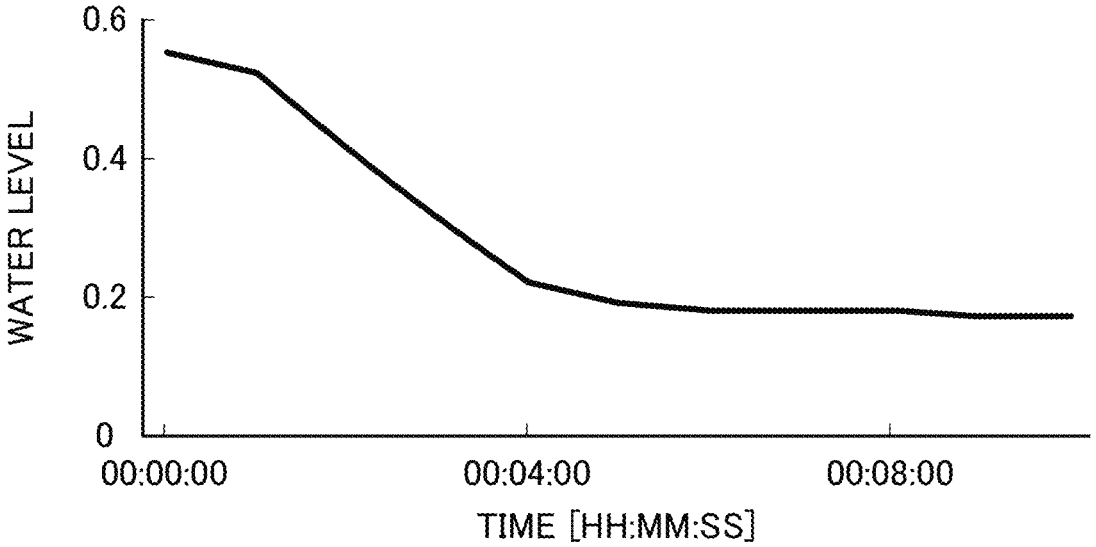
FIG. 15 is a graph illustrating temporal change of a water level in a first measurement example.
Figure 16:
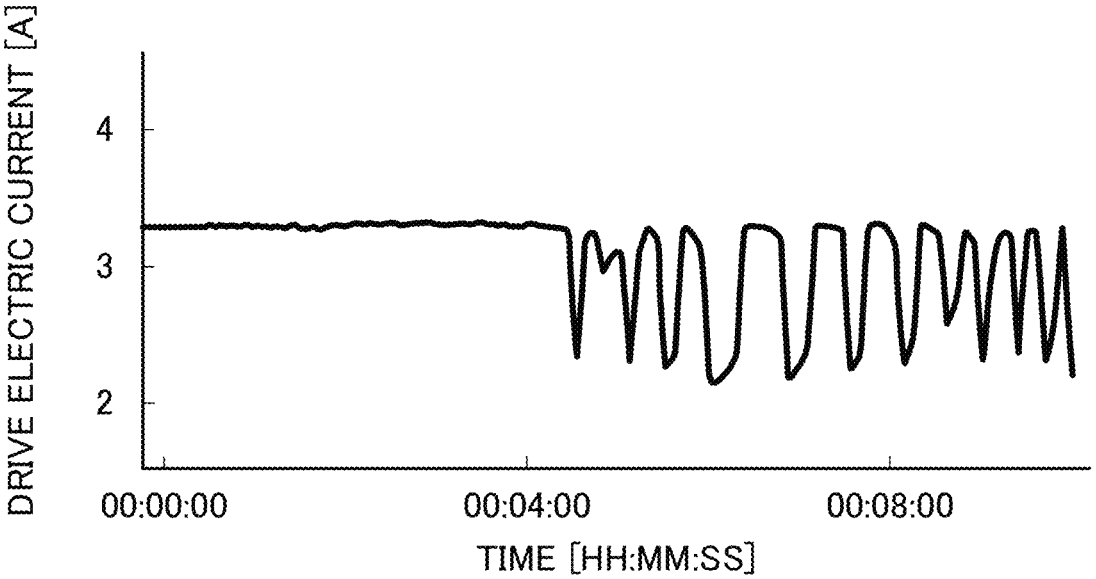
FIG. 16 is a graph illustrating temporal change of a drive electric current in the first measurement example.
Figure 17:
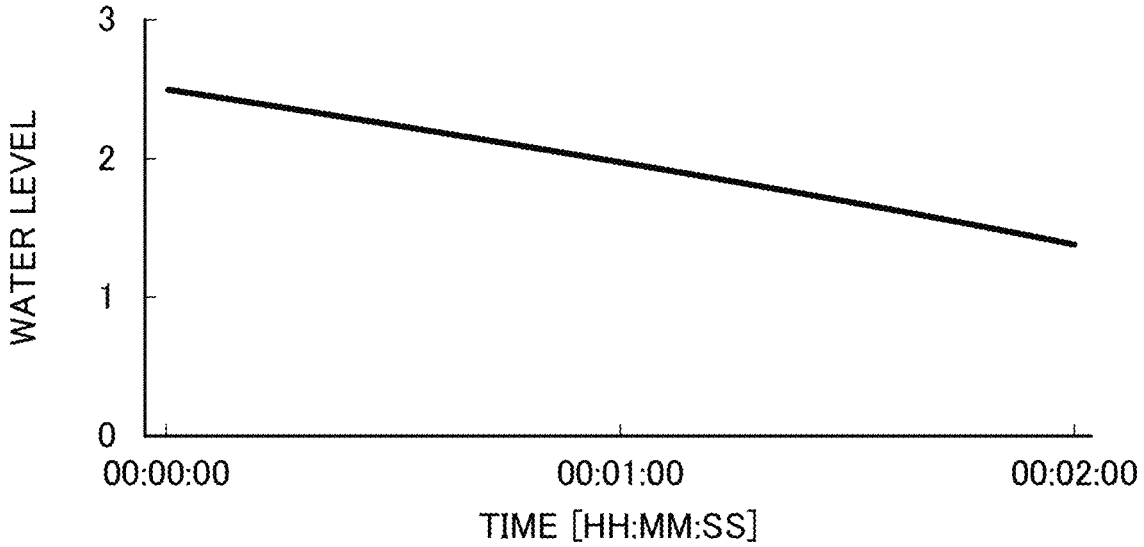
FIG. 17 is a graph illustrating temporal change of a water level in a second measurement example.

In the first measurement example, as illustrated in FIG. 15, lowering speed of the water level in the storage tank 2 transitioned substantially constantly until about four minutes elapsed from a start of measurement, and on the other hand, as illustrated in FIG. 16, a value of a drive electric current transitioned substantially constantly in a state where the value of the drive electric current was about 3.3 A. That is, it is inferred that, during the above-described time, the electric motor 7 of the submersible pump 5 normally operated and the submersible pump system 1 was stable.

However, the lowering speed of the water level changed at a time point at which about four minutes elapsed from the start of measurement and, after about four minutes elapsed from the start of measurement, the water level transitioned with an approximately constant water level (a value around "0.2" on the abscissa in FIG. 15) maintained. That is, in the first measurement example, at the time point at which about four minutes elapsed from the start of measurement, at least one water level change point was observed.

In contrast, after about four minutes elapsed from the start of measurement, a phenomenon that a value of the drive electric current reduces and increases in a range of 2.0 to 3.4 A was repeated. That is, in the first measurement example, after about four minutes elapsed from the start of measurement, a plurality of electric current change points were observed.

As described above, after about four minutes elapsed from the start of measurement, the value of the drive electric current reduced and increased with the water level in the storage tank 2 maintained in an approximately constant state. According to the above-described measurement result, it is specified that the submersible pump 5 is in a so-called idle operation state (abnormal state) because air entered in the pump main body 6. In a case where a similar event to the first measurement example occurs, the identification unit 22 identifies that the operation state of the submersible pump 5 is the "idle operation state," based on the virtual boundaries set by the above-described learning control.

SECOND MEASUREMENT EXAMPLE

Figure 18:
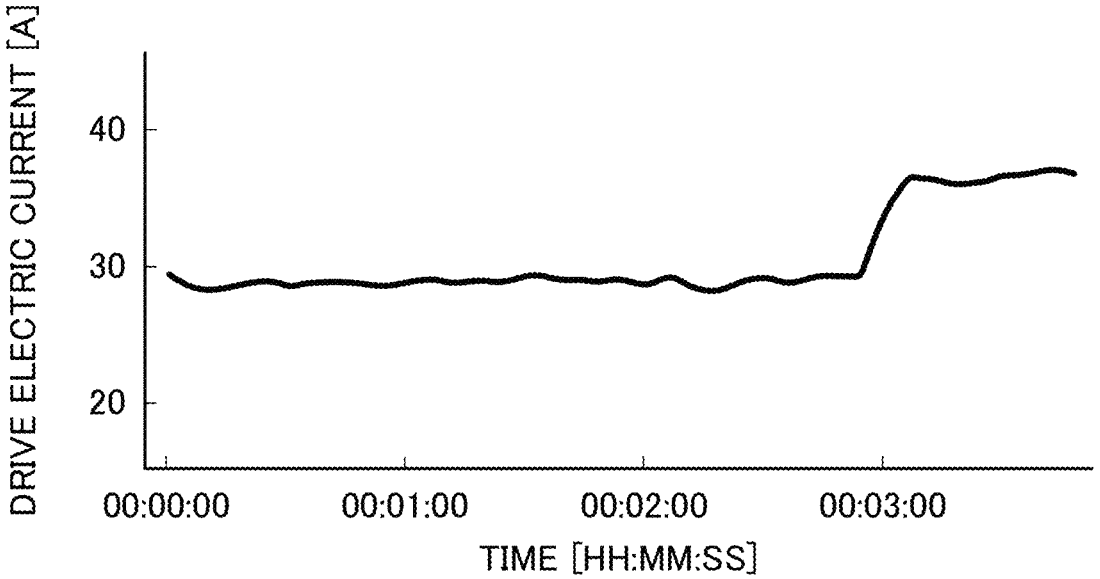
FIG. 18 is a graph illustrating temporal change of a drive electric current in the second measurement example.

In the second measurement example, the lowering speed of the water level in the storage tank 2 transitioned substantially constantly until about two minutes elapsed from a start of measurement (see FIG. 17) and the value of the drive electric current transitioned substantially constantly (30 A) (see FIG. 18). That is, it is inferred that, during the above-described time, the electric motor 7 of the submersible pump 5 normally operated and the submersible pump system 1 itself was stable.

However, as illustrated in FIG. 18, the value of the drive electric current changed at a time point at which about three minutes elapsed from the start of measurement. Specifically, at the time point at which about three minutes elapsed, the value of the drive electric current sharply increased from around 30 A to around 38 A. After the value of the drive electric current sharply increased to around 38 A, the value of the drive electric current transitioned indicating a substantially constant value (38 A). That is, in the second measurement example, two electric current change points were observed, but no water level change point was observed.

As described above, in the second measurement example, although the water level transitioned at approximately constant lowering speed, the value of the drive electric current sharply increased at the time point at which about three minutes elapsed from the start of measurement. According to the above-described measurement result, a state where some kind of foreign object flowed in the pump main body 6 of the submersible pump 5 and the foreign object blocked in the pump main body 6 (foreign object blockage) is specified. In a case where a similar event to the second measurement example occurs, the identification unit 22 identifies that the operation state of the submersible pump 5 is the "foreign object blockage," based on the virtual boundaries set by the above-described learning control.

THIRD MEASUREMENT EXAMPLE

Figure 19:
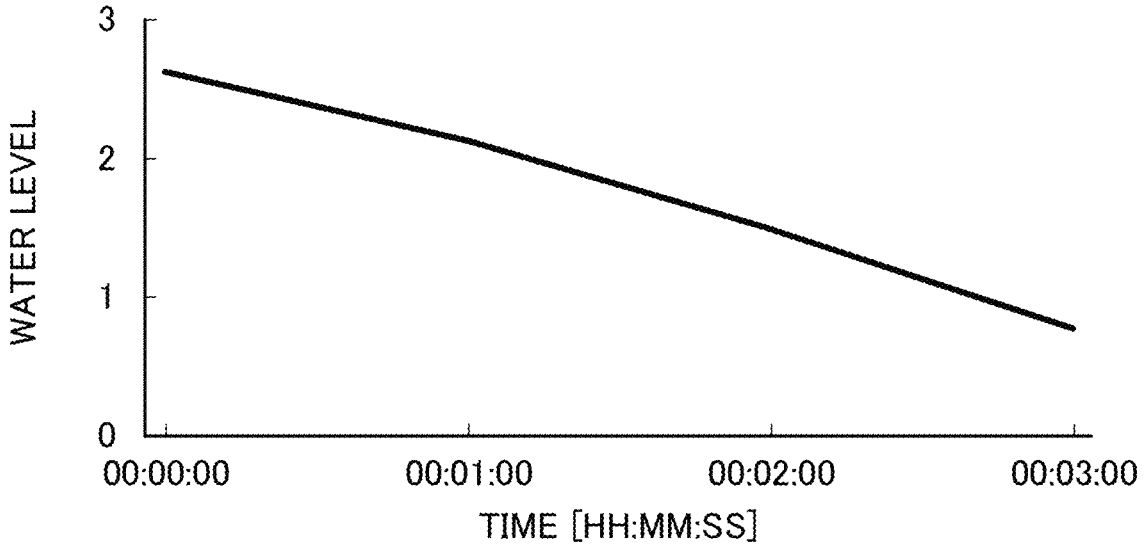
FIG. 19 is a graph illustrating temporal change of a water level in a third measurement example.
Figure 20:
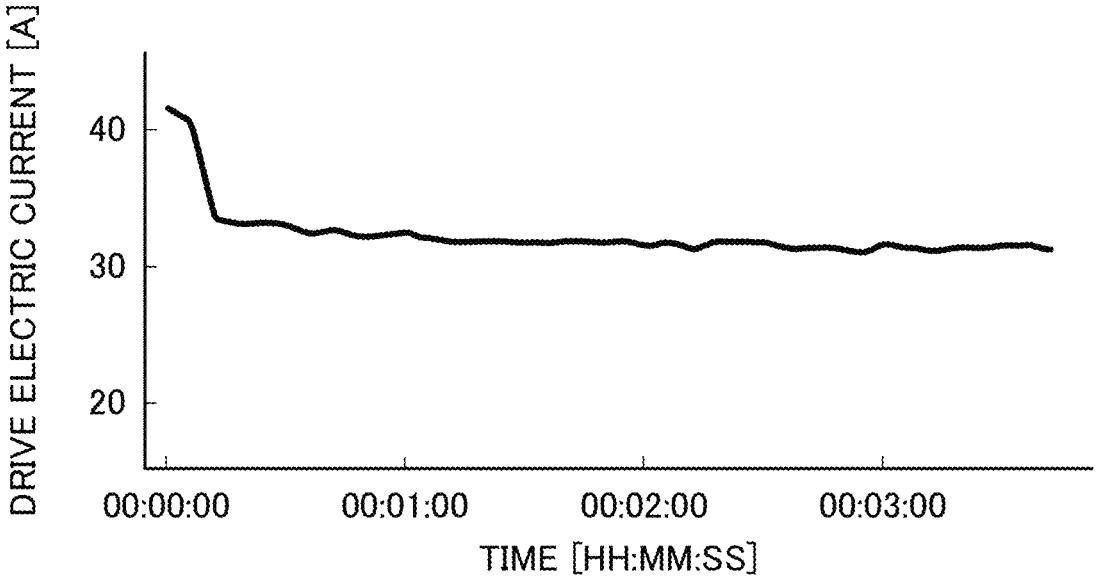
FIG. 20 is a graph illustrating temporal change of a drive electric current in the third measurement example.
Figure 21:
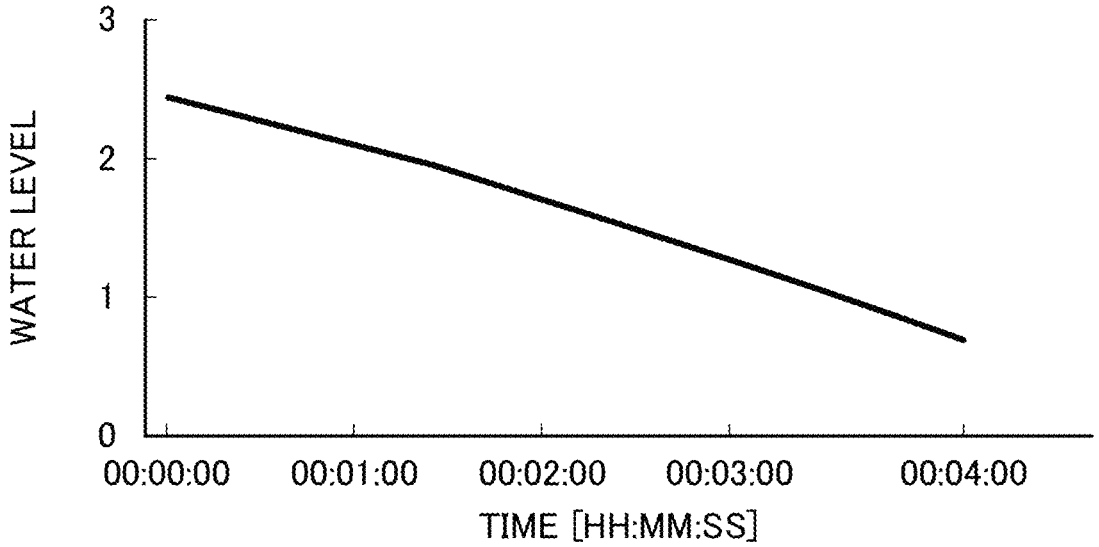
FIG. 21 is a graph illustrating temporal change of a water level in a fourth measurement example.

In the third measurement example, as illustrated in FIG. 19, the lowering speed of the water level in the storage tank 2 transitioned substantially constantly until about three minutes elapsed from a start of measurement. However, as illustrated in FIG. 20, immediately after the start of measurement, the value of the drive electric current sharply dropped from about 42 A to about 33 A. After the value of the drive electric current dropped, the value of the electric current constantly transitioned at about 33 A. As described above, in the third measurement example, one electric current change point was observed. Note that, in the third measurement example, no water level change point was observed.

As described above, in the third measurement example, while the water level transitioned at approximately constantly lowering speed, the value of the drive electric current sharply dropped immediately after the start of measurement. According to the above-described measurement result, it is specified that some kind of foreign object that stayed in the pump main body 6 of the submersible pump 5 flowed out to the outside of the pump main body 6 due to driving of the submersible pump 5 (the electric motor 7). In a case where a similar event to the third measurement example occurs, the identification unit 22 identifies that the operation state of the submersible pump 5 is "a state where some kind of foreign object that stayed in the pump main body 6 flowed out to the outside of the pump main body 6 (foreign object passing)," based on the virtual boundaries set by the above-described learning control.

FOURTH MEASUREMENT EXAMPLE

Figure 22:
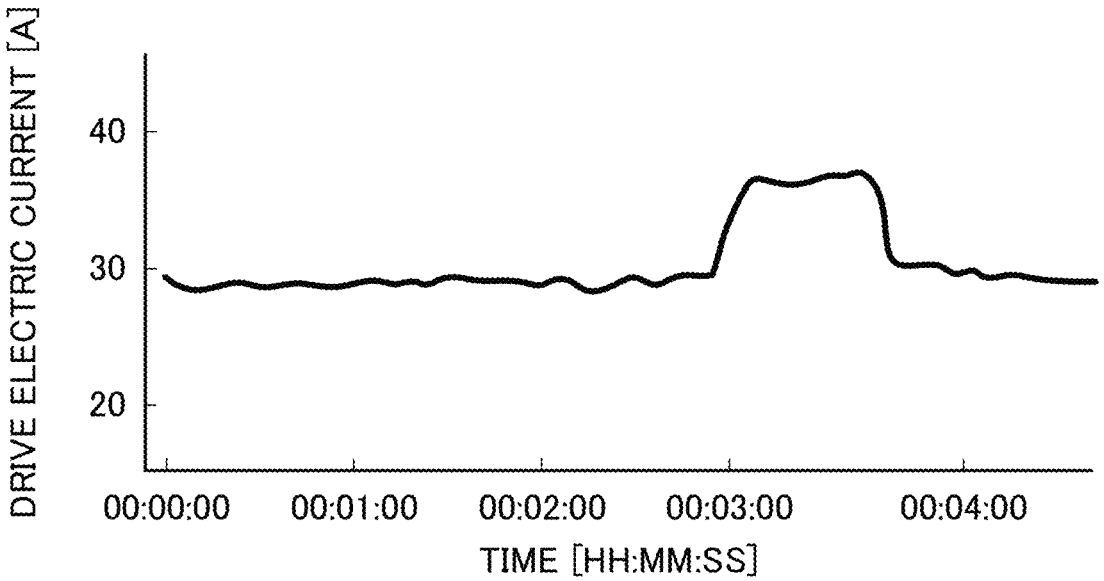
FIG. 22 is a graph illustrating temporal change of a drive electric current in the fourth measurement example.

In the fourth measurement example, the lowering speed of the water level in the storage tank 2 transitioned substantially constantly until about three minutes elapsed from a start of measurement (see FIG. 21), and the value of the drive electric current transitioned in a substantially constant state (at about 30 A) (see FIG. 22). That is, it is inferred that, during the above-described time, the electric motor 7 of the submersible pump 5 normally operated and the submersible pump system 1 itself was stable.

However, as illustrated in FIG. 22, at a time point at which about three minutes elapsed from the start of measurement, the value of the drive electric current changed. Specifically, at the time point at which about three minutes elapsed, the value of the drive electric current sharply rose from around 30 A to around 38 A. During about 30 seconds after the value of the drive electric current sharply rose, the value of the drive electric current transitioned indicating a substantially constant value. Thereafter, the value of the drive electric current sharply dropped to about 30 A. That is, in the fourth measurement example, while at least four electric current change points were observed, no water level change point was observed.

As described above, in the fourth measurement example, although the water level transitioned at approximately constant lowering speed, after a predetermined time elapsed from the start of measurement, the drive electric current sharply rose and, thereafter, the drive electric current sharply dropped after an elapse of a certain time. According to the above-described measurement result, it is specified that some kind of foreign object that flowed in the pump main body 6 of the submersible pump 5 blocked in the pump main body 6 and, thereafter, the foreign object flowed out to the outside of the pump main body 6. In a case where a similar event to the fourth measurement example occurs, the identification unit 22 identifies that the operation state of the submersible pump 5 is the "foreign object blockage" and the "foreign object passing," based on the virtual boundaries set by the above-described learning control.

FIFTH MEASUREMENT EXAMPLE

Figure 23:
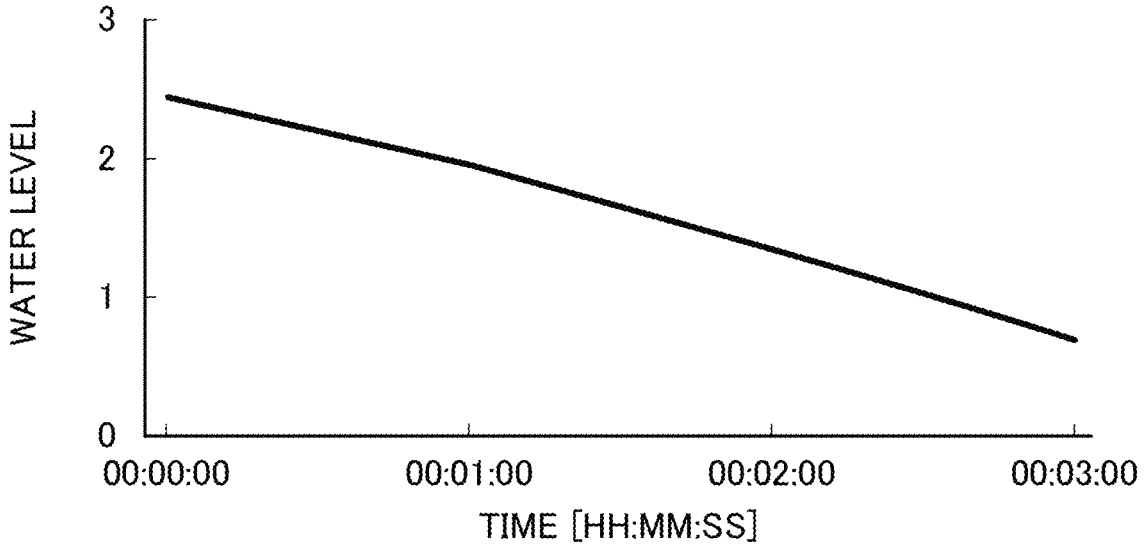
FIG. 23 is a graph illustrating temporal change of a water level in a fifth measurement example.
Figure 24:
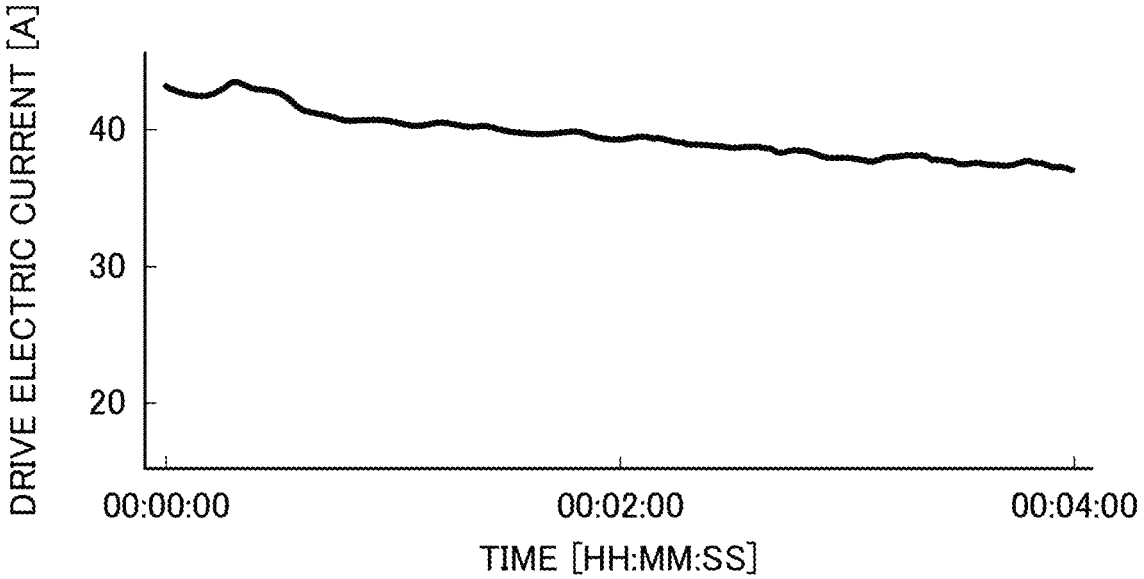
FIG. 24 is a graph illustrating temporal change of a drive electric current in the fifth measurement example.

In the fifth measurement example, as illustrated in FIG. 23, the lowering speed of the water level in the storage tank 2 transitioned substantially constantly until about three minutes elapsed from a start of measurement. However, as illustrated in FIG. 24, the value of the drive electric current gradually reduced from about 42 A to about 37 A with time while the value of the drive electric current stayed in a range higher than a value of a normal drive electric current (30 A) until about three to four minutes elapsed from the start of measurement. Note that, in the fifth measurement example, no electric current change point and no water level change point were observed.

As described above, in the fifth measurement example, while the water level transitioned at substantially constant lowering speed, the value of the drive electric current gradually reduced. According to the above-described measurement result, it is specified that some kind of foreign object stayed in the pump main body 6 of the submersible pump 5 (foreign object staying), so that the value of the drive electric current gradually reduced. In a case where a similar event to the fifth measurement example occurs, the identification unit 22 identifies that the operation state of the submersible pump 5 is the "foreign object staying," based on the virtual boundaries set by the above-described learning control.

SIXTH MEASUREMENT EXAMPLE

Figure 25:
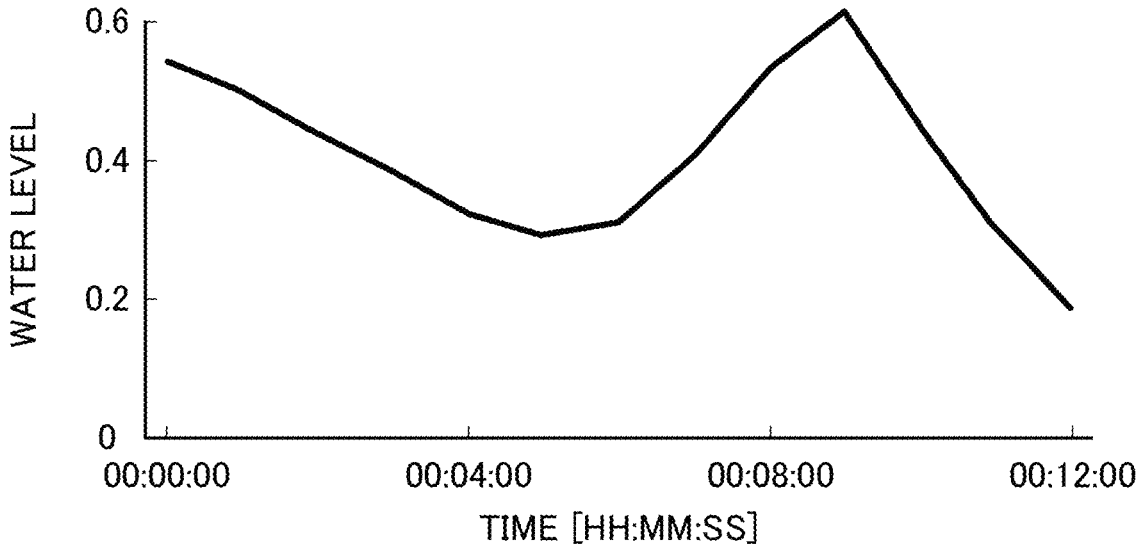
FIG. 25 is a graph illustrating temporal change of a water level in a sixth measurement example.
Figure 26:
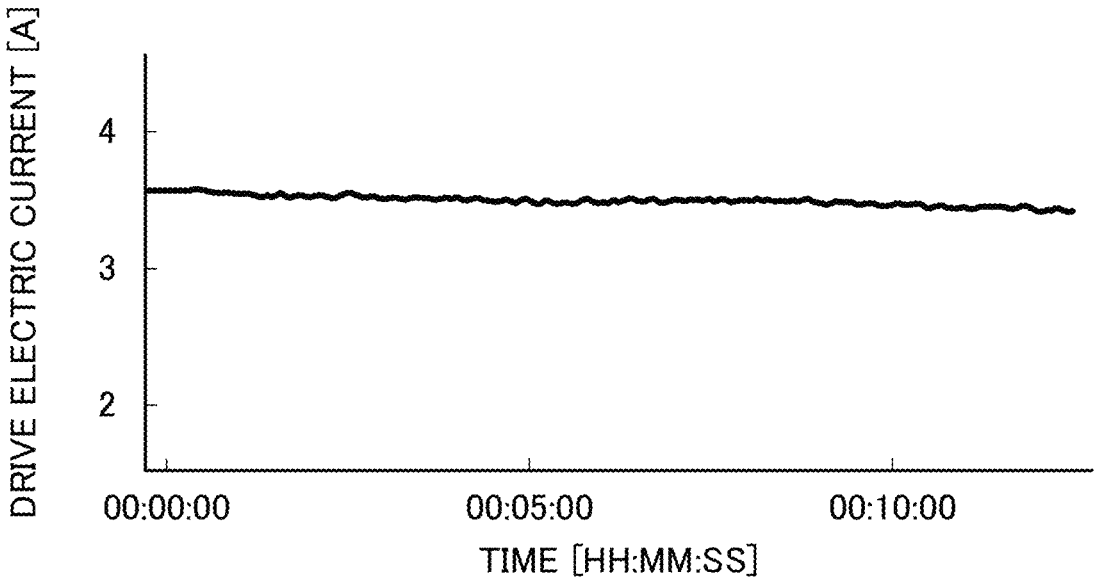
FIG. 26 is a graph illustrating temporal change of a drive electric current in the sixth measurement example.

In the sixth measurement example, the lowering speed of the water level in the storage tank 2 transitioned substantially constantly until about five minutes elapsed from a start of measurement (see FIG. 25), and the value of the drive electric current transitioned indicating a substantially constant value (3.5 A) (see FIG. 26). That is, it is inferred that, during the above-described time, the electric motor 7 of the submersible pump 5 normally operated.

However, as illustrated in FIG. 25, at a time point at which about five minutes elapsed from the start of measurement, the lowering speed of the water level changed. Specifically, after about five minutes elapsed from the start of measurement, the water level turned to rise at around 0.3 and, at a time when about nine minutes elapsed from the start of measurement, the water level rose to a value exceeding 0.6. Furthermore, after about nine minutes elapsed from the start of measurement, the water level turned to lower from around 0.6 because of an operation of the other submersible pump 5 or a stop of an inflow water amount, so that the water level reduced to a value lowered than 0.2 at a time point at which about twelve minutes elapsed from the start of measurement. That is, in the sixth measurement example, at least two water level change points were observed as temporal change of the water level.

In contrast, as illustrated in FIG. 26, the value of the drive electric current transitioned constantly at about 3.5 A until about twelve minutes elapsed from the start of measurement. That is, in the sixth measurement example, no electric current change point was observed in temporal change of the drive electric current.

As described above, in the sixth measurement example, although the water level rose and lowered, the value of the drive electric current transitioned approximately constantly. According to the above-described measurement result, a state where, in view of the planned drainage amount of the submersible pump 5, sewage excessively flowed in the storage tank 2 and the water level of the sewage in the storage tank 2 was not stably lowered (over-capacity inflow) is specified. In a case where a similar event to the sixth measurement example occurs, the identification unit 22 identifies that the operation state of the submersible pump 5 is the "over-capacity inflow," based on the virtual boundaries set by the learning control.

SEVENTH MEASUREMENT EXAMPLE

Figure 27:
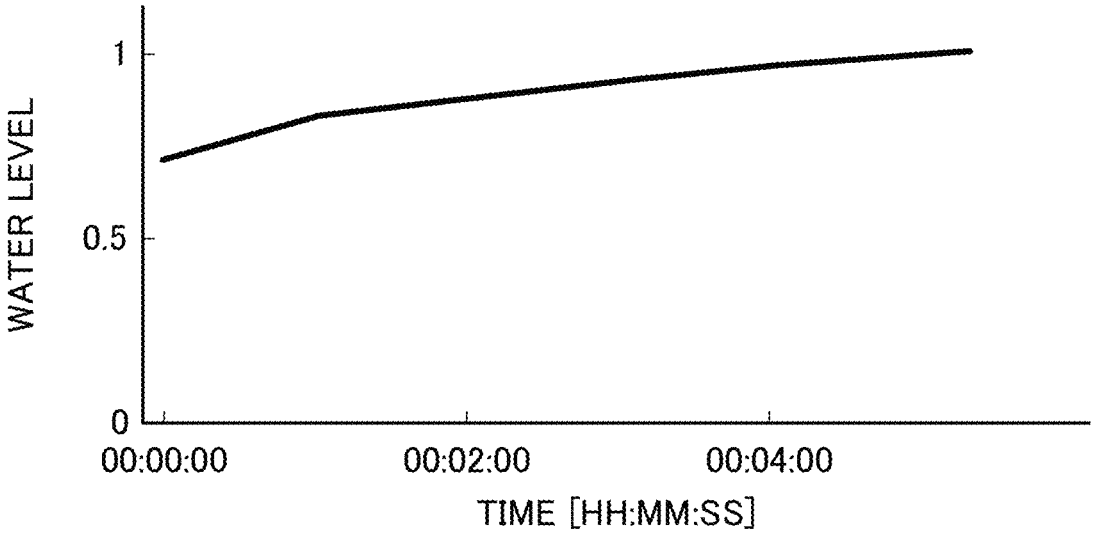
FIG. 27 is a graph illustrating temporal change of a water level in a seventh measurement example.
Figure 28:
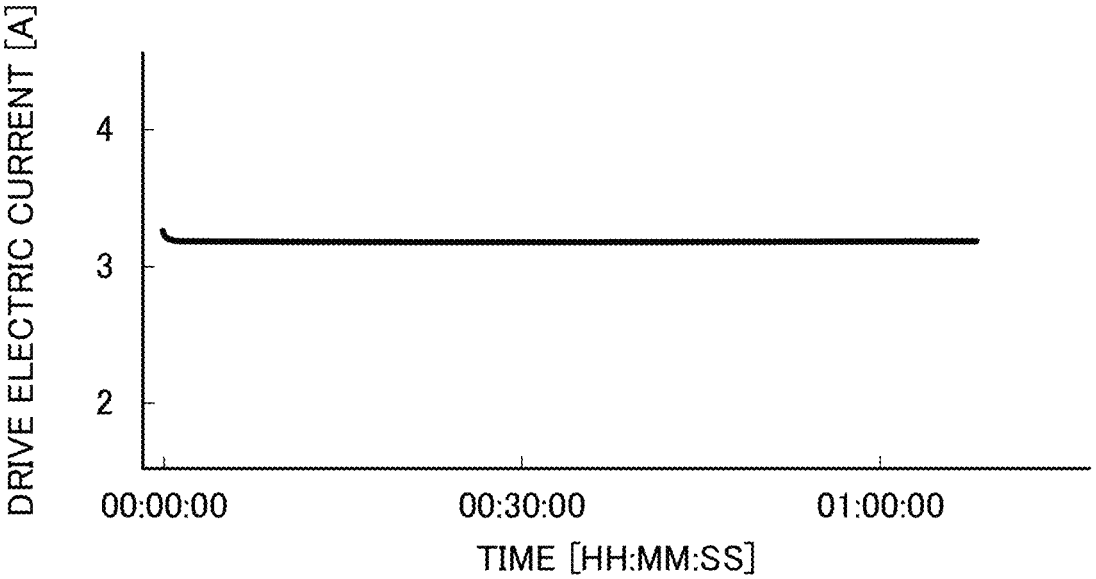
FIG. 28 is a graph illustrating temporal change of a drive electric current in the seventh measurement example.

In the seventh measurement example, as illustrated in FIG. 27, the water level in the storage tank 2 rose immediately after a start of measurement and, even at a time point at which four minutes elapsed from the start of measurement, the water level continued to rise. In contrast, as illustrated in FIG. 28, the value of the drive electric current transitioned indicating at substantially constant value (about 3.1 A) from the start of measurement. Note that, in the seventh measurement example, no electric current change point and no water level change point were observed.

As described above, in the seventh measurement example, while the water level in the storage tank 2 continued to rise from the start of measurement, the value of the drive electric current transitioned in a substantially constant state (about 3.1 A) from the start of measurement. According to the above-described measurement result, a state where sewage flowed in the storage tank 2 in an amount exceeding an assumed inflow amount due to an external factor, such as, for example, heavy rain, or the like (excessive inflow) is specified. In a case where a similar event to the seventh measurement example occurs, the identification unit 22 identifies that the operation state of the submersible pump 5 is the "excessive inflow," based on the virtual boundaries set by the above-described learning control.

Effects of Embodiment

As described above, in the submersible pump system 1 according to this embodiment, the identification unit 22 is configured to calculate at least one electric current parameter of the plurality of electric current parameters, based on temporal change of the drive electric current stored in the storage unit 21 and identify the operation state of the submersible pump 5, based on the electric current parameter. According to the above-described configuration, by conducting a detailed analysis, based on the at least one electric current parameter calculated from the temporal change of the drive electric current in the submersible pump 5, the operation state (for example, an airlock, an idle operation, foreign object blockage, foreign object passing, foreign object staying, over-capacity inflow, and excessive inflow) of the submersible pump 5 can be specifically specified. Therefore, in the submersible pump system 1, a type of an abnormal operation of the submersible pump 5 can be specifically specified and failure contents of the submersible pump system 1 can be made clear.

By making the failure contents in the submersible pump system 1 clear, it is possible to take measures to restore the submersible pump system 1 from a failure state in advance, for example, before going to the pump station in which the submersible pumps 5 are installed. It is also possible to change as appropriate an order of priorities in order to restore the submersible pump system 1 from a failure state. Furthermore, it is possible to perform preventive maintenance of the submersible pump system 1.

The plurality of electric current parameters include the standard deviation of the drive electric current, the maximum value and the minimum value of the drive electric current, the ratio between the maximum value and the minimum value of the drive electric current, the change amount of the drive electric current per unit time, and the total number of electric current change points, that is, points at which the degree of temporal change of the drive electric current changed, during a predetermined period. Thus, by conducting a detailed analysis using different types of electric current parameters, the operation state of the submersible pump 5 can be highly accurately specified.

The identification unit 22 may be configured to calculate at least one water level parameter of the plurality of water level parameters and identify the operation state of the submersible pump 5, based on the water level parameter and the electric current parameter. According to the above-described configuration, it is possible to analyze the temporal change of the drive electric current and the temporal change of the water level in detail while mutually comparing the water level parameter and the electric current parameter with one another. As a result, accuracy with which the operation state of the submersible pump 5 is specified can be increased.

The identification unit 22 may be also configured to calculate two or more electric current parameters of the plurality of electric current parameters and identify the operation state of the submersible pump 5, based on the electric current parameters. According to the above-described configuration, it is possible to analyze the temporal change of the drive electric current in detail while mutually comparing the different electric current parameters. As a result, the accuracy with which the operation state of the submersible pump 5 is specified can be further increased.

Moreover, the identification unit 22 can be configured to calculate at least one water level parameter of the plurality of water level parameters based on the temporal change of the water level and identify the operation state of the submersible pump 5, based on the water level parameter. According to the above-described configuration, it is possible to specifically specify the operation state of the submersible pump 5 by analyzing the temporal change of the water level in detail, based on the at least one water level parameter. Accordingly, the failure contents of the submersible pump system 1 can be made clear.

The identification unit 22 is configured to execute learning control in which virtual boundaries that divide the operation state of the submersible pump 5 are set using one or more electric current parameters and/or one or more water level parameters. According to the above-described configuration, accuracy with which the operation state of the submersible pump 5 is identified can be increased and, as a result, the failure contents of the submersible pump system 1 can be made even clearer.

The detection unit 8 for pump is configured to detect at least one of the water content of oil contained in the pump main body 6, the flooded state in the electric motor 7, the temperature of the bearing member forming the submersible pump 5, the discharge amount (flow rate) of the sewage discharged from the pump main body 6, the discharge pressure of the pump main body 6, and the oscillation value, insulation resistance value, and winding temperature of the electric motor 7, and therefore, based on a detection result of the detection unit 8 for pump, it is possible to individually specify failure contents caused by a specific configuration of each of the submersible pumps 5 and also predict a future failure. Specifically, the detection unit 8 for pump detects a state where a state of shifting from a normal value to an abnormal value for at least one of the above-described elements, so that the failure contents of the submersible pump 5 caused by the specific configuration and a portion thereof that has been deteriorated through years can be individually specified and a failure of the submersible pump 5 can be prevented in advance.

The identification unit 22 predicts a future operation state of the submersible pump 5 from both of the operation state of the submersible pump 5 and the detection result of the detection unit 8 for pump, so that the future operation state of the submersible pump 5 can be predicted with high accuracy.

The identification unit 22 informs (outputs) the external device 30 of a type of an abnormal operation of the submersible pump 5, based on the operation state of the submersible pump 5 (see S7 illustrated in FIG. 5), so that the failure contents of the submersible pump system 1 can be understood in an early stage. As a result, measures to restore the submersible pump system 1 from a failure state can be taken in an early stage.

The control unit 20 performs control such that, based on the operation state of each of the submersible pumps 5, one of the submersible pumps 5 that has been determined to be highly likely in an abnormal state from an identification result of the identification unit 22 is stopped to be driven only at emergency. Thus, it is possible to auxiliary use the one of the submersible pumps 5 that has been determined to be highly likely in an abnormal state by the identification unit 22 as a backup submersible pump.

OTHER EMBODIMENTS

In the above-described embodiment, a mode in which two submersible pumps 5 are provided has been described. However, the number of the submersible pumps 5 is not limited thereto. For example, a mode in which one submersible pump 5 is provided may be employed. Alternatively, a mode in which three or more submersible pumps 5 are provided may be employed.

In the above-described embodiment, a mode in which the bubble-type water level detector 10 is used has been described. However, the water level detector 10 is not limited thereto. For example, a so-called pressure-type water level detector that detects the water level, based on a water pressure of sewage stored in the storage tank 2, may be used.

In the above-described embodiment, a mode based on the first to ninth combinations achieved by two-dimensionally combining one or more electric current parameters and/or one or more water level parameters as learning control in the identification unit 22 including the artificial intelligence (AI) function has been described. However, the learning control is not limited thereto. For example, as some other combination, many specified parameters of electric current parameters and/or water level parameters may be arbitrarily selected to be input to the identification unit 22 (AI), and thus, virtual boundaries may be obtained, based on multi-dimensional combinations.

In the above-described embodiment, a mode in which the identification unit 22 executes the above-described learning control has been described. However, the learning control is not limited thereto. For example, the storage unit 21 may include an artificial intelligence (AI) function and may be configured to execute the above-described learning control.

In the above-described embodiment, a mode in which the identification unit 22 including the artificial intelligence (AI) function identifies the operation state of the submersible pump 5, based on the virtual boundaries set by the above-described learning control has been described. However, how to identify the operation state of the submersible pump 5 is not limited thereto. That is, the identification unit 22 may not include artificial intelligence (AI) function, and a mode in which the operation state of the submersible pump 5 is identified based on a pre-set threshold may be employed.

In the above-described embodiment, the drive electric current has been indicated by an electric current value in order to make it easily understood. However, a value (set value) normalized by a set electric current value may be used. Similarly, for the water level, a value (set value) normalized by a set value may be used. Moreover, similarly, for the operation time (seconds), a value (set value) normalized by a time required for one operation or a set value may be used.

Each of the storage unit 21 and identification unit 22 of the above-described embodiment illustrated in FIG. 4 may be configured as a computer that is caused to function as the submersible pump system 1 or an information processing device (for example, including the control device, such as the control board 9) for a water pump by a computer program. The computer program may be, for example, stored in advance in the storage unit 21 and may be in a form in which the computer program is downloaded from the server device on the cloud. Alternatively, the computer program may be in a form in which, in maintaining the submersible pumps 5 or the like installed in some other pump station, the computer program stored in a storage medium, such as a USB memory or the like, is read.

Embodiments of the present disclosure have been described above, the present disclosure is not limited to the embodiments described above, and various changes and modifications may be made without departing from the scope of the present disclosure.

INDUSTRIAL APPLICABILITY

The present disclosure is industrially applicable as, for example, a submersible pump system used as a control system of a manhole pump system, a sewage drainage pumping station, or the like, an information processing device for a submersible pump, and a computer program.

DESCRIPTION OF REFERENCE CHARACTERS

1: Submersible pump system
2: Storage tank
3: Inflow pipe
4: Discharge pipe
5: Submersible pump
6: Pump main body
7: Electric motor
8: Detection unit for pump
9: Control board
10: Water level detector
11: Air pump
12: Air discharge unit
13: Air tube
14: Pressure sensor
15: Water level control unit
16: Water gauge
17: Controller
20: Control unit
21: Storage unit
22: Identification unit
23: Electric current detection unit
30: External device

The invention claimed is:

1. A submersible pump system, comprising:
a submersible pump that pumps stored water;
an electric current detection unit that detects a drive electric current value of the submersible pump;
a storage unit that stores the drive electric current value detected by the electric current detection unit; and
an identification unit that can transmit and receive data to and from the storage unit,
wherein
the storage unit is configured to store temporal change of the detected drive electric current of the submersible pump, and
the identification unit is configured to calculate at least one electric current parameter of a plurality of electric current parameters based on the temporal change of the drive electric current and identify an operation state indicating whether there is an abnormality in the submersible pump and a type of an abnormal operation, based on the electric current parameter, the at least one electric current parameter including a total number of electric current change points, that is, points at which a degree of the temporal change of the drive electric current changed.

2. The submersible pump system of claim 1, wherein
the plurality of electric current parameters include a standard deviation of the drive electric current, a maximum value and a minimum value of the drive electric current, a ratio between the maximum value and the minimum value of the drive electric current, and a change amount of the drive electric current per unit time.

3. The submersible pump system of claim 1, further comprising:
a water level detector that detects a water level of the stored water,
wherein
the storage unit is configured to store temporal change of the water level detected by the water level detector, and
the identification unit is configured to calculate at least one water level parameter of a plurality of water level parameters based on the temporal change of the water level and identify the operation state of the submersible pump, based on the water level parameter and the electric current parameter.

4. The submersible pump system of claim 1, wherein
the identification unit is configured to calculate two or more electric current parameters of the plurality of electric current parameters and identify the operation state of the submersible pump, based on the electric current parameters.

5. The submersible pump system of claim 1, wherein
at least one of the identification unit and the storage unit is configured to execute learning control in which a virtual boundary that divides the operation state of the submersible pump is set using the electric current parameter, and
the virtual boundary is set as a boundary to divide whether there is an abnormality in the submersible pump and types of abnormal operation based on the electric current parameter, using a machine learning method or deep learning.

6. The submersible pump system of claim 1, wherein
the submersible pump includes a detection unit for pump, and
the detection unit for pump is configured to detect at least one of a water content of oil contained in a pump main body forming the submersible pump, a flooded state in an electric motor forming the submersible pump, temperature of a bearing member forming the submersible pump, a discharge amount and a discharge pressure of the submersible pump, and an oscillation value, an insulation resistance value, and winding temperature of the electric motor.

7. The submersible pump system of claim 6, wherein
the identification unit is configured to predict a future operation state of the submersible pump from both of the operation state of the submersible pump and a detection result of the detection unit for pump.

8. The submersible pump system of claim 1, wherein
the identification unit is configured to inform an external device of a type of an abnormal operation of the submersible pump, based on the operation state of the submersible pump.

9. The submersible pump system of claim 8, further comprising:
a control unit that controls operation and stop of the submersible pump, wherein
a plurality of the submersible pumps are provided, and
the control unit performs control such that one of the submersible pumps that has been determined to be highly likely in an abnormal state, based on the operation state of each of the plurality of submersible pumps, by the identification unit is stopped to be driven only at emergency.

10. A non-transitory computer readable medium having stored thereon computer-readable instructions that, when executed by a computer, cause the computer to operate as the electric current detection unit, the storage unit, and the identification unit of claim 1.

11. An information processing device that specifies an operation state indicating whether there is an abnormality in a submersible pump and a type of an abnormal operation, the information processing device comprising:

a storage unit that stores a drive electric current value of the submersible pump; and an identification unit that can transmit and receive data to and from the storage unit, a control unit that controls the operation state of the submersible pump wherein the storage unit is configured to store temporal change of the drive electric current of the submersible pump, and the identification unit is configured to calculate at least one electric current parameter of a plurality of electric current parameters based on the temporal change of the drive electric current and identify the operation state of the submersible pump, based on the electric current parameter, the at least one electric current parameter including a total number of electric current change points, that is, points at which a degree of the temporal change of the drive electric current changed, the control unit is configured to cause the submersible pump to be stopped to be driven if the operation state is in an abnormal state.

12. The information processing device of claim 11, wherein the storage unit is configured to store temporal change of a water level, and the identification unit is configured to calculate at least one water level parameter of a plurality of water level parameters based on the temporal change of the water level and identify the operation state of the submersible pump, based on the water level parameter and the electric current parameter, the at least one water level parameter including a total number of water level change points, that is, points at which a degree of the temporal change of the water level changed.

13. A computer readable medium having stored therein a computer program that is used for specifying an operation state indicating whether there is an abnormality in a submersible pump and a type of an abnormal operation, the computer program causing a computer to execute a process, the process comprising:

causing the submersible pump to be stopped to be driven if the operation state is in an abnormal state, and causing the computer to function as:

a storage unit that stores a drive electric current value of the submersible pump; and an identification unit that can transmit and receive data to and from the storage unit, wherein the storage unit is configured to store temporal change of the detected drive electric current of the submersible pump, and the identification unit is configured to calculate at least one electric current parameter of a plurality of electric current parameters based on the temporal change of the drive electric current and identify the operation state of the submersible pump, based on the electric current parameter, the at least one electric current parameter including a total number of electric current change points, that is, points at which a degree of the temporal change of the drive electric current changed.

14. The computer program of claim 13, wherein the storage unit is configured to store temporal change of the water level, and the identification unit is configured to calculate at least one water level parameter of a plurality of water level parameters based on the temporal change of the water level and identify the operation state of the submersible pump, based on the water level parameter and the electric current parameter, the at least one water level parameter including a total number of water level change points, that is, points at which a degree of the temporal change of the water level changed.

* * * * *